US006910271B2

(12) United States Patent
Peterson et al.

(10) Patent No.: US 6,910,271 B2
(45) Date of Patent: Jun. 28, 2005

(54) MECHANICAL HIGHLY COMPLIANT THERMAL INTERFACE PAD

(75) Inventors: Eric C. Peterson, McKinney, TX (US); Brent A. Boudreaux, Highland Village, TX (US); Christian L. Belady, Richardson, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 275 days.

(21) Appl. No.: 10/283,907

(22) Filed: Oct. 29, 2002

(65) Prior Publication Data

US 2004/0079519 A1 Apr. 29, 2004

(51) Int. Cl.[7] ..... B21D 53/02; H05K 7/20

(52) U.S. Cl. ..... 29/890.03; 165/81; 165/185; 257/718; 361/704

(58) Field of Search ..... 165/80.3, 81, 82, 165/185; 174/16.3; 257/718, 719, 722; 361/704; 29/890.03

(56) References Cited

U.S. PATENT DOCUMENTS 4,263,965 A * 4/1981 Mansuria et al. ..... 165/185
4,498,530 A * 2/1985 Lipschutz ..... 165/185
4,535,841 A * 8/1985 Kok ..... 165/185
5,014,117 A * 5/1991 Horvath et al. ..... 257/122
5,052,481 A * 10/1991 Horvath et al. ..... 165/185
5,201,866 A * 4/1993 Mok ..... 165/80.3
5,515,912 A * 5/1996 Daikoku et al. ..... 165/185
5,705,850 A * 1/1998 Ashiwake et al. ..... 257/719
RE35,721 E * 2/1998 Daikoku et al. ..... 165/185
5,751,062 A * 5/1998 Daikoku et al. ..... 257/722

* cited by examiner

*Primary Examiner*—Leonard R. Leo
(74) *Attorney, Agent, or Firm*—Leslie P. Gehman

(57) ABSTRACT

A thermal interface pad is constructed from a plurality of thermal interface plate assemblies. Alternate thermal interface plate assemblies are rotated about 180 degrees from each other within the pad. Each plate assembly includes one or more spring members configured such that the completed thermal interface pad includes a plurality of spring members on at least two sides of the pad. The thermal interface plate assemblies are configured to allow the thermal interface pad to vary greatly in thickness. The pad is sufficiently adjustable in thickness to accommodate gross tolerance differences between multiple heat generating and sinking devices. Rods inserted in openings in the plates may be used to align the plate assemblies and to apply compressive force to the plates, improving the thermal conductivity between adjacent plates and greatly decreasing the overall thermal resistance of the thermal interface pad.

27 Claims, 20 Drawing Sheets

Section B-B

Section B-B

Section D-D

Section E-E

MECHANICAL HIGHLY COMPLIANT THERMAL INTERFACE PAD

FIELD OF THE INVENTION

The present invention is related generally to the field of heat transfer and more specifically to the field of thermal contact resistance during heat transfer.

BACKGROUND OF THE INVENTION

Modern electronics have benefited from the ability to fabricate devices on a smaller and smaller scale. As the ability to shrink devices has improved, so has their performance. Unfortunately, this improvement in performance is accompanied by an increase in power as well as power density in devices. In order to maintain the reliability of these devices, the industry must find new methods to remove this heat efficiently.

By definition, heat sinking means that one attaches a cooling device to a heat-generating component and thereby removes the heat to some cooling medium, such as air or water. Unfortunately, one of the major problems in joining two devices to transfer heat is that a thermal interface is created at the junction. This thermal interface is characterized by a thermal contact impedance. Thermal contact impedance is a function of contact pressure and the absence or presence of material filling small gaps or surface variations in the interface.

As the power density of electronic devices increases, heat transfer from the heat generating devices to the surrounding environment becomes more and more critical to the proper operation of the devices. Many current electronic devices incorporate heat sink fins to dissipate heat to the surrounding air moving over the fins. These heat sinks are thermally connected to the electronic devices by a variety of techniques. Some devices use a thermally conductive paste in an attempt to lower the contact resistance. Others may use solder between the two elements both for mechanical strength and thermal conductance. However, these two solutions require additional cost and process steps that would not be necessary except for presence of the contact resistance, and also only work for small gap sizes on the order of a few mils.

The heat-sinking problem is particularly difficult in devices such as multi-chip modules ("MCMs") where multiple components need to have topside cooling into a single cold plate or heat sink. The various components within the multi-chip module may not be of equal thickness, creating a non-coplanar surface that often must be contacted to a single planar surface of the cold plate or heat sink. Engineers have developed a variety of approaches to solving the non-coplanar surface problem, such as, gap fillers comprising thick thermal pads capable of absorbing 10 to 20 mils of stack up differences. However, the thickness and composition of these thermal pads often results in a relatively high thermal resistance making them suitable only for low power devices. Others have used pistons with springs attached to them attached to a plurality of small cold plates or heat sinks to account for the irregularity of the stack up. However, this can become an expensive solution to the problem. Still others have used an array of small cold plates connected together by flexible tubing allowing some flexibility between the plates to account for the variations in height of the components. However, once again, this solution may become too expensive for many products.

Other solutions include the use of thermal grease or phase change materials, such as paraffin, to fill in small gaps, such as the microscopic roughness between two surfaces. However, thermal grease and phase change materials are unable to fill larger gaps such as those present in multi-chip modules.

SUMMARY OF THE INVENTION

A thermal interface pad is constructed from a plurality of thermal interface plate assemblies. Alternate thermal interface plate assemblies are rotated about 180 degrees from each other within the pad. Each plate assembly includes one or more spring members configured such that the completed thermal interface pad includes a plurality of spring members on at least two sides of the pad. The thermal interface plate assemblies are configured to allow the thermal interface pad to vary greatly in thickness. The pad is sufficiently adjustable in thickness to accommodate gross tolerance differences between multiple heat generating and sinking devices. Rods inserted in openings in the plates may be used to align the plate assemblies and to apply compressive force to the plates, improving the thermal conductivity between adjacent plates and greatly decreasing the overall thermal resistance of the thermal interface pad.

Other aspects and advantages of the present invention will become apparent from the following detailed description, taken in conjunction with the accompanying drawings, illustrating by way of example the principles of the invention.

DETAILED DESCRIPTION

Figure 1:
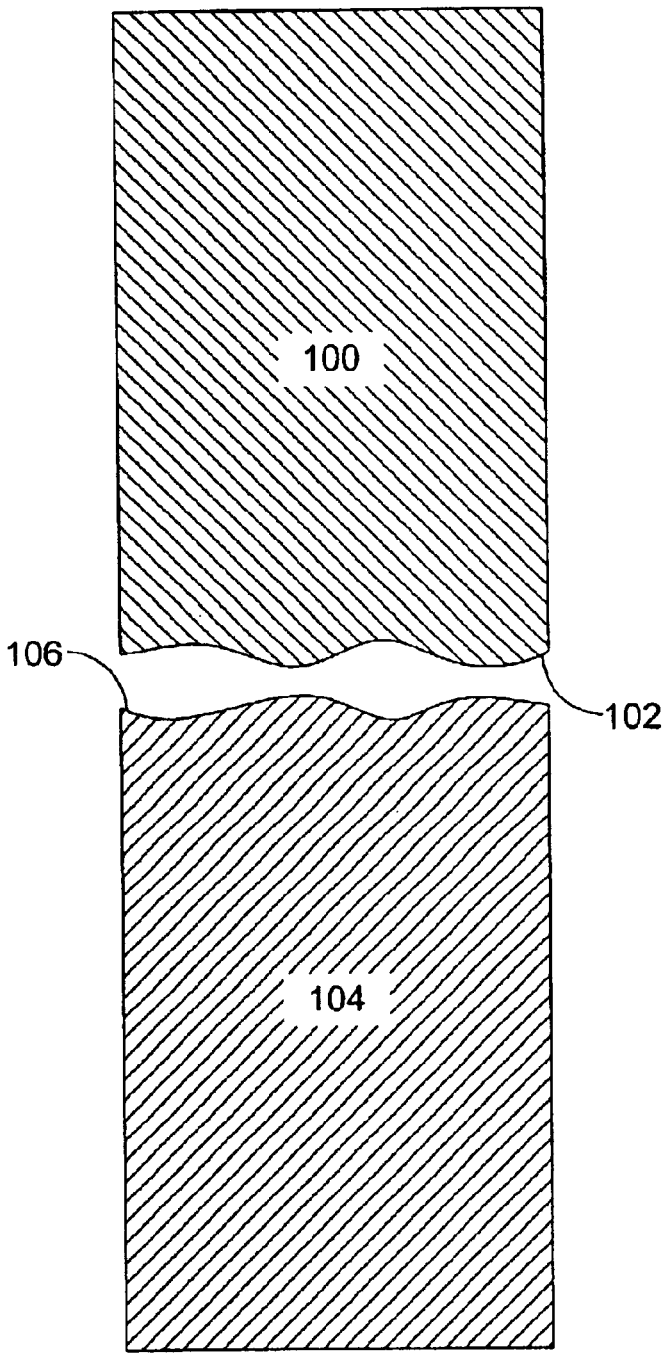
FIG. 1 PRIOR ART
FIG. 1 is a cross-section of the interface between two surfaces.

FIG. 1 is a cross-section of the interface between two surfaces. In this greatly magnified view of the interface between two surfaces, a first object 100 having a first surface 102 is brought into contact with a second object 104 having a second surface 106. Neither surface is perfectly flat resulting in an imperfect mating of the two surfaces. This imperfect interface contributes to a thermal contact resistance at the interface between the two objects.

Figure 2:
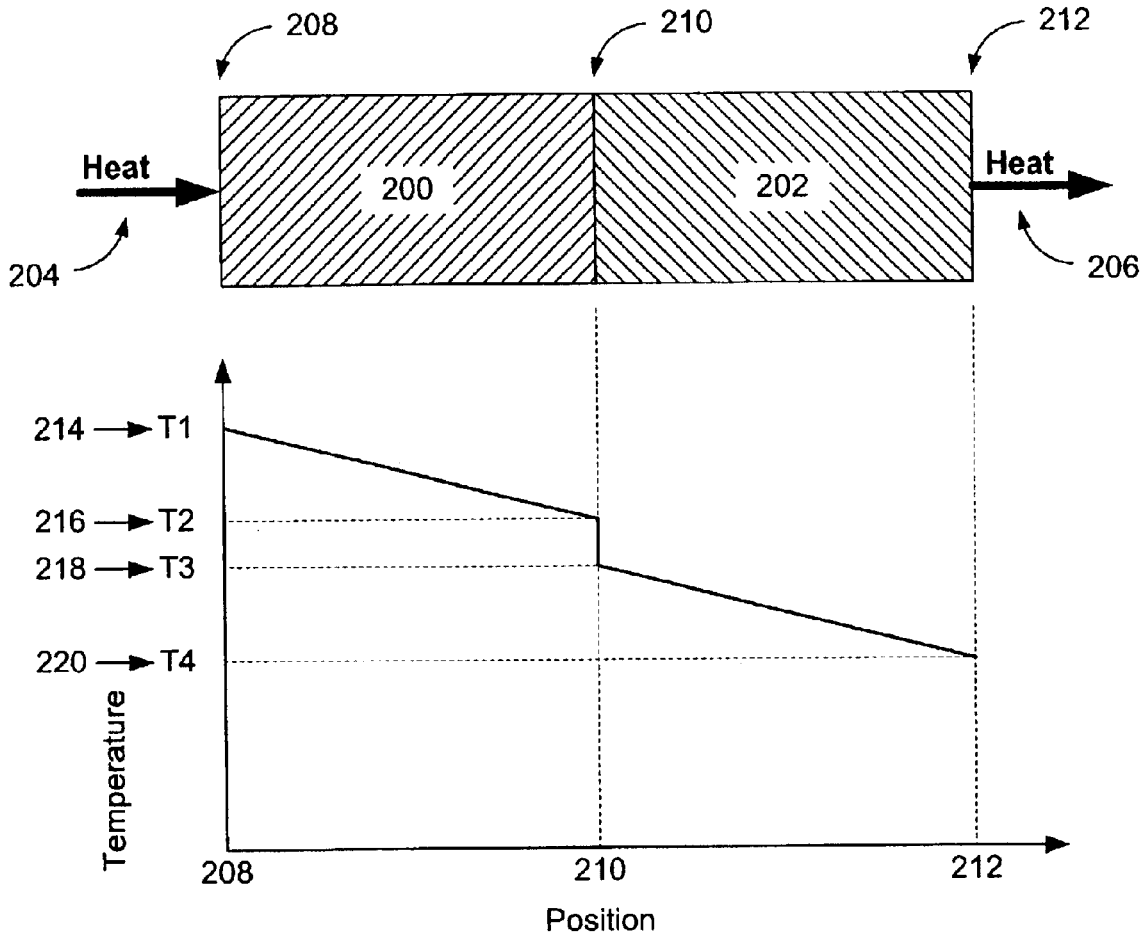
FIG. 2 PRIOR ART
FIG. 2 is a graph of temperature versus position through an interface between two thermal conductors.

FIG. 2 is a graph of temperature versus position through an interface between two thermal conductors. In this view of two thermally conductive objects joined together, a graph of temperature versus position is shown below a cross-sectional view of the two objects including the thermal interface 210 between them. A first object 200 is joined with a second object 202 producing a thermal interface 210 at the point where the objects join. As shown in FIG. 1, this interface between the two objects is not a perfect joint and contributes to a thermal contact resistance at the thermal interface 210. When thermal energy as heat 204 enters the first object 200, passes through it to the second object 202, before exiting the second object as heat 206, the thermal energy must pass through the thermal interface 210 between the two objects. The thermal energy enters the first object 200 at a position 208 and a temperature T1 214, and decreases to a temperature T2 216 as it passes through the first object 200. At the thermal interface 210 between the two objects the thermal energy must overcome a thermal contact resistance and the temperature decreases to a temperature T3 218 as it enters the second object 202. The temperature decreases to a temperature T4 220 as it passes through the second object 202 where it is radiated as heat 206 at a position 212.

Figure 3A:
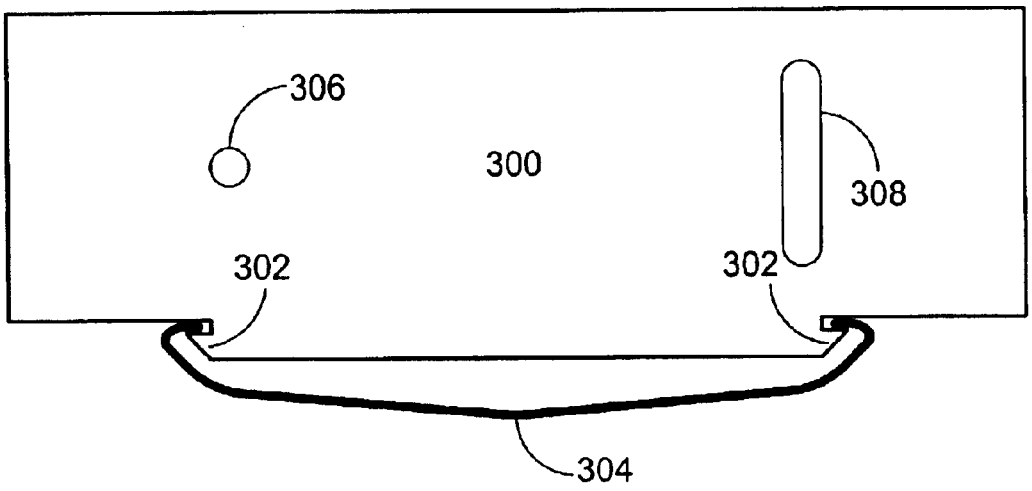
FIG. 3A is a front view of an example embodiment of a thermal interface plate assembly according to the present invention.

FIG. 3A is a front view of an example embodiment of a thermal interface plate assembly according to the present invention. A thermal interface plate 300 is constructed from any thermally conductive material, such as aluminum or copper, including a first opening 306 (in this embodiment, a circular hole) and a second opening 308 (in this embodiment, a slot). The first opening 306 may be any shape as desired to receive a rod used to hold a plurality of thermal interface plates 300 together and apply compression to the plurality of thermal interface plates 300 as needed by a particular implementation of the present invention. The second opening 308 in an example embodiment of the present invention is configured to allow the rod to move in at least one direction. Other embodiments of the present invention may not need thickness adjustability and may use a second hole as the second opening. Two prongs 302 are provided along an edge of the thermal interface plate 300. The prongs 302 are configured to accept a spring 304. Those of skill in the art will recognize that there are a wide variety of methods to attach a spring 304 to a plate 300 all within the scope of the present invention. Also, a wide variety of spring designs and configurations may be used within the scope of the present invention. FIG. 3 is simply a representation of one possible embodiment of the present invention showing one example method of attaching a spring 304 to the plate 300. Since the spring 304 is not critical to heat flow through the thermal interface pad, it need not be made from thermally conductive material. Instead the spring material may be selected for its mechanical characteristics ignoring its thermal characteristics. The completed plate 300 including the first opening 306, second opening 308 and spring 304 is termed a thermal interface plate assembly.

Figure 3B:
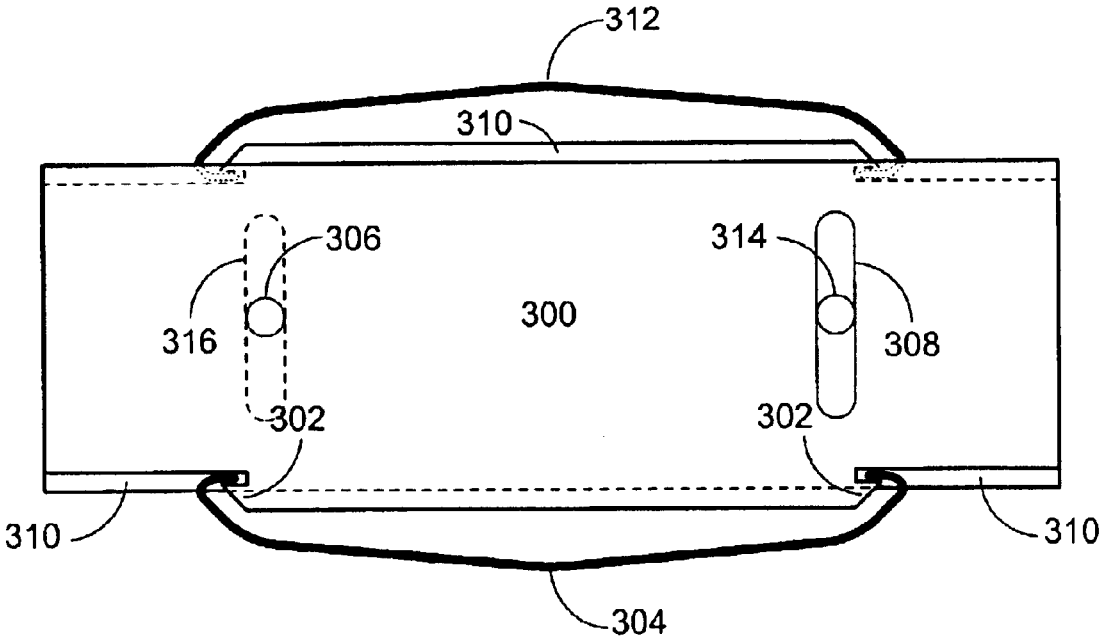
FIG. 3B is a front view of an example embodiment of a thermal interface pad comprising a plurality of thermal interface plate assemblies from FIG. 3A according to the present invention.

FIG. 3B is a front view of an example embodiment of a thermal interface pad comprising a plurality of thermal interface plate assemblies from FIG. 3A according to the present invention. A thermal interface plate assembly from FIG. 3A is shown on top of a plurality of similar thermal interface plate assemblies. Alternate plate assemblies are rotated about 180 degrees from each other within the thermal interface pad. This alternation of plate assemblies results in a pad with a plurality of springs on opposing surfaces of the final thermal interface pad. In an example embodiment of the present invention, the individual thermal interface plates are configured to overlap the prongs of adjacent plates. This overlap may be used to keep the springs attached to their respective plates. A second plate 310 may be seen directly behind the first plate 300. The first plate includes a first opening 306, second opening 308, prongs 302, and a spring 304. The second plate 310 includes a first opening 314 (in this embodiment, a circular hole), a second opening 316 (in this embodiment, a slot), prongs, and a spring 312 attached to the second plate 310 on the prongs. Notice that since alternating plates are rotated about 180 degrees from each other, the holes in plates with springs facing up are aligned with the slots from the plates with springs facing down. Likewise, the slots in plates with springs facing up are aligned with the holes from the plates with springs facing down. Rods may then be inserted in both sets of holes such that the two rods may slide vertically within the slots. This allows the thickness of the thermal interface pad to be adjusted within the limits defined by the dimensions of the holes and slots. Threaded rods may be used with nuts to tighten the stack of plate assemblies into a thermal interface pad that is of a set thickness. This clamping of the stack also may apply pressure between adjacent plates greatly improving the thermal conductivity between plates allowing greater dissipation of any hot spots within the pad.

Note that some embodiments of the present invention need not clamp the stack to the point where individual plates cannot move. Some embodiments of the present invention may use springs or other devices to apply sufficient pressure to the stack to allow heat to flow between the plates, but still allow the plates to shift with respect to each other. One possible embodiment of the present invention uses threaded rods through the holes in the plates with springs placed between the nuts on the ends of the rods and the assembly, providing pressure on the assembly, but still allowing the plates to shift with respect to each other.

The springs attached to each plate are useful mainly for applying a compressive force on the interfaces with the heat sinking and heat generating devices. Since the contact area of the springs to the adjacent devices are relatively small, little heat is transferred through the springs. Heat passes into the assembly through the edges of the plates, then transfers to adjacent plates before passing out of the assembly through the edges of the alternating plates.

Note that other embodiments of the present invention may use any number of holes and slots in any combination as required for specific applications within the scope of the present invention. While circular holes are shown in the figures, any shape may be used within the scope of the present invention. Rods may be threaded bolts with nuts on one or both ends to hold together the stack of plates and apply compression to the stack. Other embodiments of the present invention may use friction fit rods instead of threaded rods, or any other means to hold together the stack of plates. In some embodiments of the present invention if no adjustment of height is needed, the plates may be permanently affixed to each other by means other than rods in holes, such as glues or solders. If thermally conductive, the glue or solder will also enable the transfer of heat from plate to plate in addition to supplying any rigidity necessary in the thermal interface pad.

Other embodiments of the present invention may use two slots in the plates instead of a slot and a hole. This allows the thickness of the thermal interface pad to vary across the assembly. Thus, the thermal interface pad may be used as a thermal interface between two surfaces that may be non-planar to a degree beyond what can be filled with thermal grease or conductive pads.

Note that the depth of the thermal interface pad may be varied by changing the number of thermal interface plate assemblies used in creating the pad. Also the width of the pad is determined by the width of the thermal interface plates and may be varied without limit within the scope of the present invention.

Figure 4A:
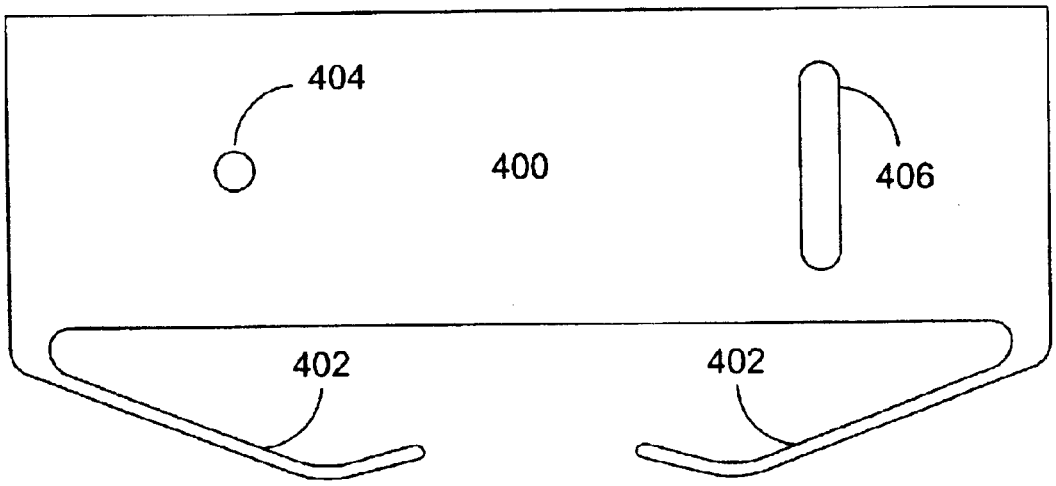
FIG. 4A is a front view of an example embodiment of a thermal interface plate assembly according to the present invention.

FIG. 4A is a front view of an example embodiment of a thermal interface plate assembly according to the present invention. In an example embodiment of the present invention a thermal interface plate assembly is created by constructing a thermal interface plate 400 including a pair of spring members 402, a first opening 404 (in this embodiment, a circular hole), and a second opening 406 (in this embodiment, a slot). In some embodiments of the present invention the spring members 402 may be fabricated separately from the thermal interface plate 400, and during manufacture mechanically affixed to the thermal interface plate 400 through a process such as soldering or welding. The thermal interface plate may be constructed from any thermally conductive material, such as aluminum or copper. The spring members do not necessarily need to be constructed from the same material as the plate. Since the spring members are not critical to heat flow through the thermal interface pad, they need not be made from thermally conductive material. Instead the spring member material may be selected for its mechanical characteristics ignoring its thermal characteristics. Similar to the embodiment of the present invention shown in FIG. 3A, the first opening 404 and second opening 406 are configured to align with a corresponding second opening 406 and first opening 404 in an adjacent thermal interface plate 400 that is rotated about 180 degrees. This allows a thermal interface pad constructed from a plurality of like thermal interface plate assemblies to be adjustable in thickness. In some embodiments of the present invention, adjustable thickness may not be necessary or desirable, in which case the thermal interface plate 400 may be constructed with one or more holes 404 and no slots 406, thus eliminating thickness adjustability.

Figure 4B:
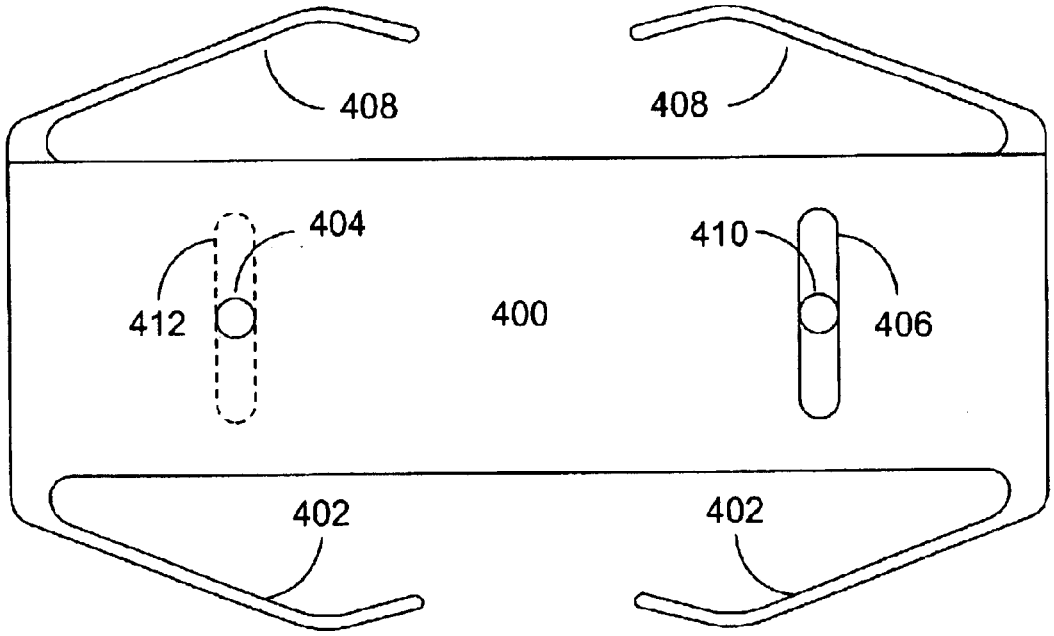
FIG. 4B is a front view of an example embodiment of a thermal interface pad comprising a plurality of thermal interface plate assemblies from FIG. 4A according to the present invention.

FIG. 4B is a front view of an example embodiment of a thermal interface pad comprising a plurality of thermal interface plate assemblies from FIG. 4A according to the present invention. A thermal interface plate assembly from FIG. 4A is shown on top of a plurality of similar thermal interface plate assemblies. Alternate plate assemblies are rotated about 180 degrees from each other within the thermal interface pad. This alternation of plate assemblies results in a pad with a plurality of springs on opposing surfaces of the final thermal interface pad. The first plate includes a first opening 404 (in this embodiment, a circular hole), second opening 406 (in this embodiment, a slot), and two spring members 402. The second plate includes a first opening 410 (in this embodiment, a circular hole), a second opening 412 (in this embodiment, a slot), and a pair of spring members 408. Notice that since alternating plates are rotated about 180 degrees from each other, the holes in plates with springs facing up are aligned with the slots from the plates with springs facing down. Likewise, the slots in plates with springs facing up are aligned with the holes from the plates with springs facing down. Rods may then be inserted in both sets of holes such that the two rods may slide vertically within the slots. This allows the thickness of the thermal interface pad to be adjusted within the limits defined by the dimensions of the holes and slots. Threaded rods may be used with nuts to tighten the stack of plate assemblies into a thermal interface pad that is of a set thickness. This clamping of the stack also may apply pressure between adjacent plates greatly improving the thermal conductivity between plates allowing greater dissipation of any hot spots within the pad.

Figure 5A:
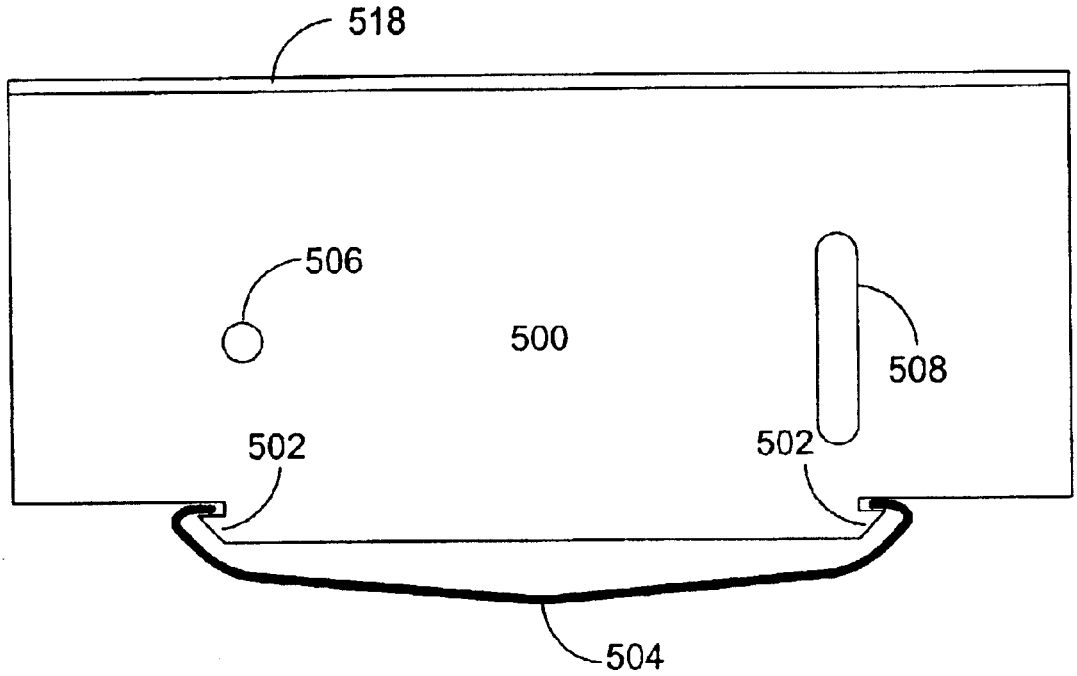
FIG. 5A is a front view of an example embodiment of a thermal interface plate assembly according to the present invention.

FIG. 5A is a front view of an example embodiment of a thermal interface plate assembly according to the present invention. This example embodiment of the present invention is similar to that shown in FIG. 3A however the thermal interface body is taller than that of FIG. 3A and also includes a ledge 518 along the top edge. A thermal interface plate 500 is constructed from any thermally conductive material, such as aluminum or copper, including a first opening 506 (in this embodiment, a circular hole) and a second opening 508 (in this embodiment, a slot). The first opening 506 may be any shape as desired to receive a rod used to hold a plurality of thermal interface plates 500 together and apply compression to the plurality of thermal interface plates 500 as needed by a particular implementation of the present invention. The second opening 508 in an example embodiment of the present invention is configured to allow the rod to move in at least one direction. Other embodiments of the present invention may not need thickness adjustability and may use a second hole in place of a slot. Two prongs 502 are provided along an edge of the thermal interface plate 500. The prongs 502 are configured to accept a spring 504. The completed plate 500 including the first opening 506, second opening 508 and spring 504 is termed a thermal interface plate assembly. The ledge 518 along the top edge is used to improve heat transfer between the thermal interface pad and the adjacent heat generating or heat-sinking device. By constructing a ledge 518 equal in thickness to the plate 500 the area contacting the adjacent device is doubled, resulting in lower thermal contact resistance.

Figure 5B:
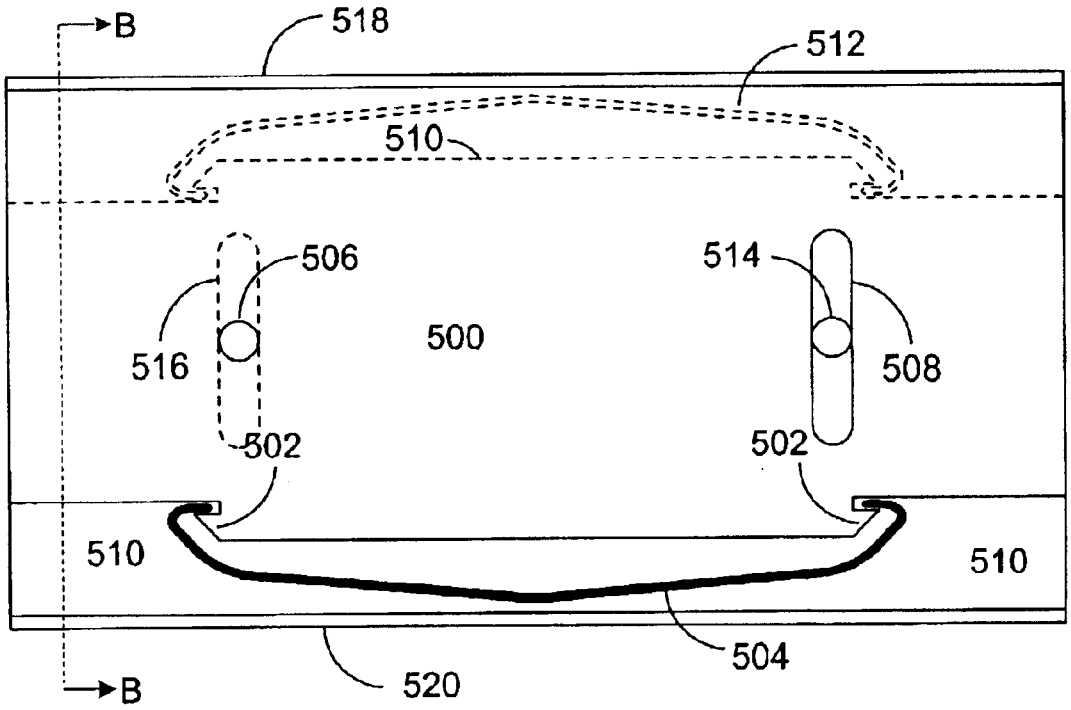
FIG. 5B is a front view of an example embodiment of a thermal interface pad comprising a plurality of thermal interface plate assemblies from FIG. 5A according to the present invention.

FIG. 5B is a front view of an example embodiment of a thermal interface pad comprising a plurality of thermal interface plate assemblies from FIG. 5A according to the present invention. A thermal interface plate assembly from FIG. 5A is shown on top of a plurality of similar thermal interface plate assemblies. Alternate plate assemblies are rotated about 180 degrees from each other within the thermal interface pad. This alternation of plate assemblies results in a pad with a plurality of springs facing opposing surfaces of the final thermal interface pad. In this example embodiment of the present invention, the individual thermal interface plates are configured to overlap the prongs and springs of adjacent plates. The ledges are used to protect the springs from any contact with external devices. Each spring may be enclosed by two adjacent thermal interface plates. A second plate 510 may be seen directly behind the first plate 500. The first plate includes a first opening 506, second opening 508, a ledge 518, prongs 502, and a spring 504. The second plate 510 includes a first opening 514 (in this embodiment, a circular hole), a second opening 516 (in this embodiment, a slot), a ledge 520, prongs, and a spring 512 attached to the second plate 510 on the prongs. Notice that since alternating plates are rotated about 180 degrees from each other, the holes in plates with springs facing up are aligned with the slots from the plates with springs facing down. Likewise, the slots in plates with springs facing up are aligned with the holes from the plates with springs facing down. Rods may then be inserted in both sets of holes such that the two rods may slide vertically within the slots. This allows the thickness of the thermal interface pad to be adjusted within the limits defined by the dimensions of the holes and slots. Threaded rods may be used with nuts to tighten the stack of plate assemblies into a thermal interface pad that is of a set thickness. This clamping of the stack also may apply pressure between adjacent plates greatly improving the thermal conductivity between plates allowing greater dissipation of any hot spots within the pad.

Figure 6A:
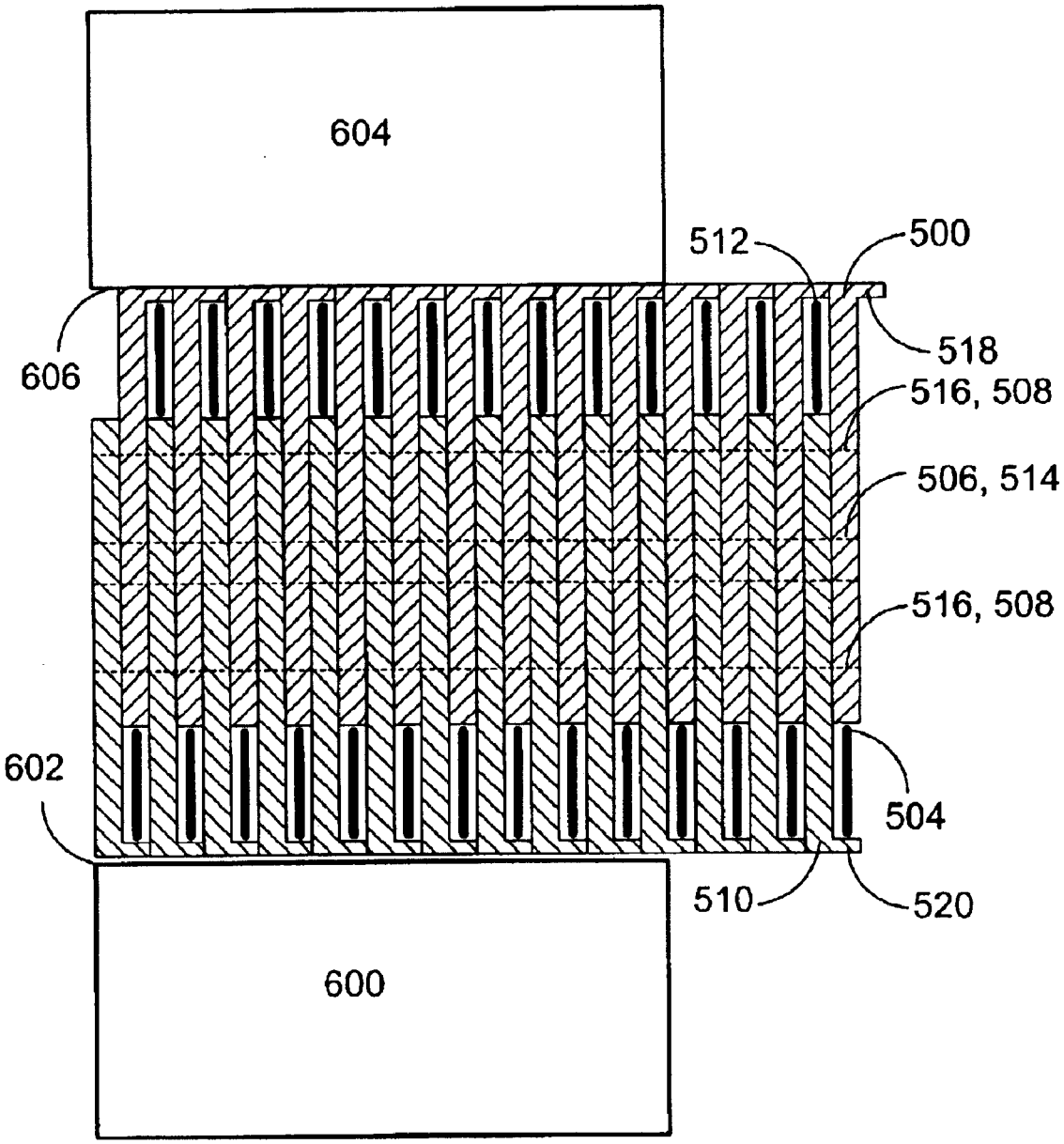
FIG. 6A is a cross-sectional view of the example embodiment of a thermal interface pad according to the present invention from FIG. 5B along section line B—B.

FIG. 6A is a cross-sectional view of the example embodiment of a thermal interface pad according to the present invention from FIG. 5B along section line B—B. In this cross-sectional view, the first plate 500, and second plate 510 are shown along with a plurality of other thermal interface plate assemblies stacked behind them. This cross-sectional view shows that each of the springs are enclosed by the ledges of an adjacent plate. For example the spring 512 from the second plate 510 is covered by the first plate 510, and the ledge from the plate behind it keeps the spring from contacting any device affixed to the top of the thermal interface pad. The spring 504 from the first plate 510 is protected by the ledge 520 from the second plate 510. In actual use an end plate may be placed over the first plate 500 to keep the spring 504 attached to the first plate 500. In an example embodiment of the present invention a heat generating device 600 and a heat-sinking device 604 are shown thermally coupled with a thermal interface pad. Note that the common surface 602 between the heat generating device 600 and the thermal interface pad may be covered with a thermal grease to decrease thermal resistance between the heat generating device 600 and the thermal interface pad. Likewise the common surface 606 between the thermal interface pad and the heat-sinking device 604 may be covered with thermal grease to decrease thermal resistance. Heat from the heat generating device 600 enters the thermal interface pad through edge of the plates oriented the same as the second plate 510 including the ledges 520 on these plates. Heat then spreads throughout the plates oriented the same as the second plate 510 and into the plates oriented the same as the first plate 500. Heat is transferred from the edges of the plates oriented the same as the first plate 500 including the ledges 518 into the heat-sinking device 604. Notice how these ledges effectively double the contact area between the heat sinking and generating devices and the thermal interface pad.

Figure 6B:
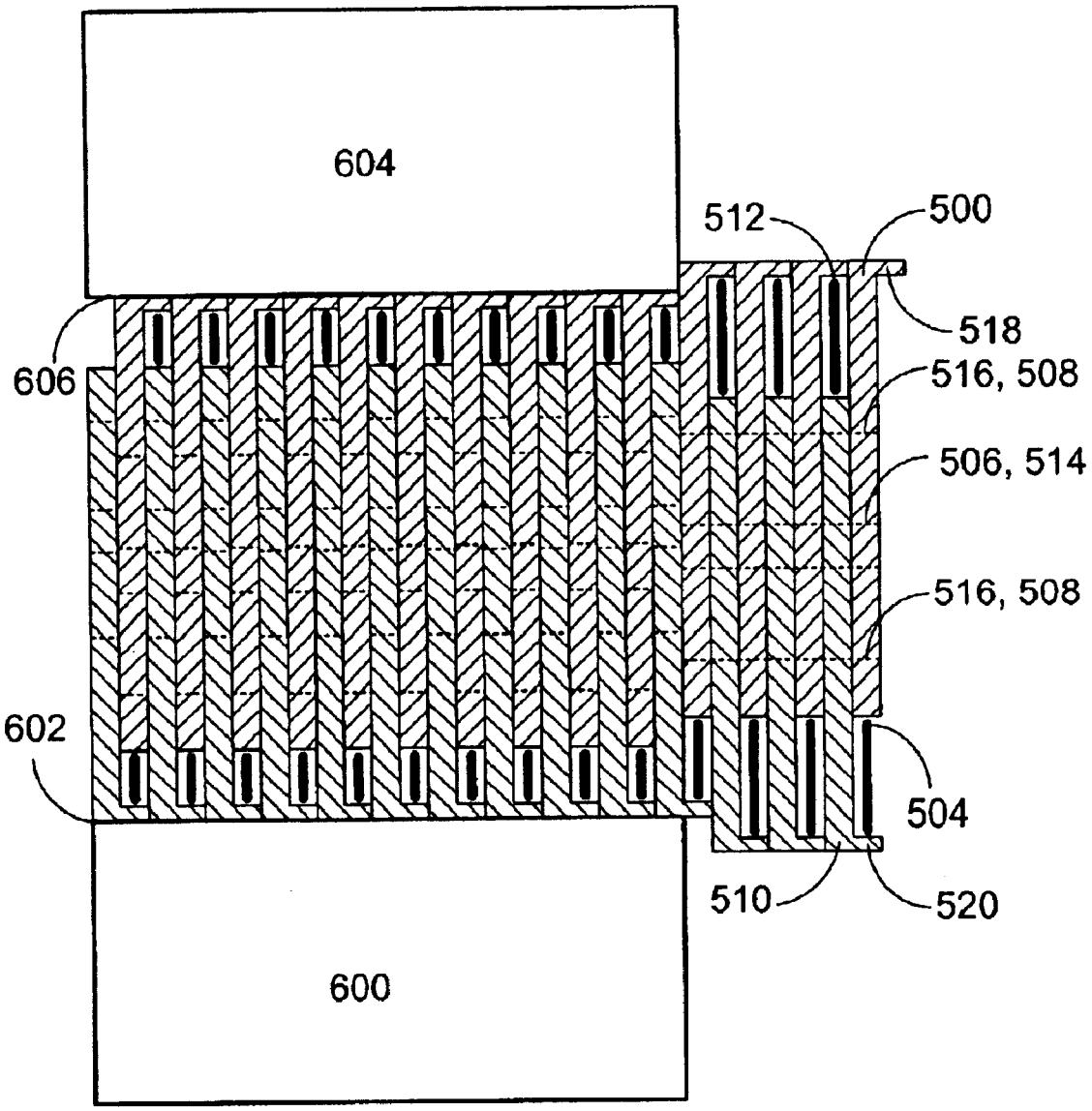
FIG. 6B is a cross-sectional view of the example embodiment of a thermal interface pad according to the present invention from FIG. 6A where the heat generating and heat sinking devices have moved closer together, compressing a portion of the thermal interface pad.

FIG. 6B is a cross-sectional view of the example embodiment of a thermal interface pad according to the present invention from FIG. 6A where the heat generating and heat sinking devices have moved closer together, compressing a portion of the thermal interface pad.

Figure 7:
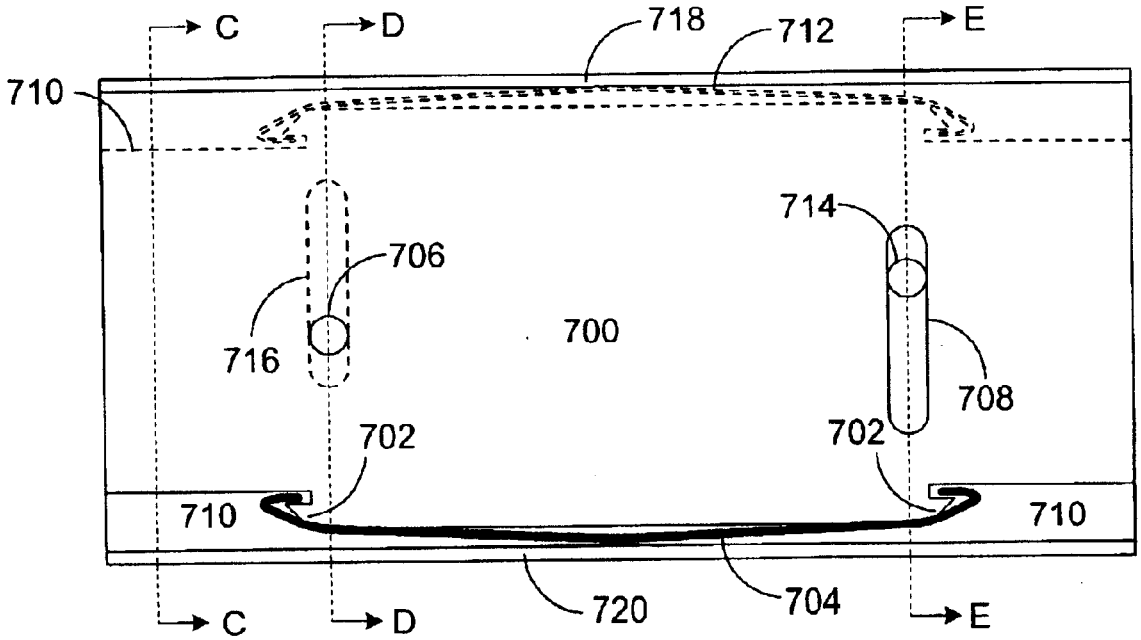
FIG. 7 is a front view of an example embodiment of the thermal interface pad according to the present invention from FIG. 5B after compression.

FIG. 7 is a front view of an example embodiment of the thermal interface pad according to the present invention from FIG. 5B after compression. In an example embodiment of the present invention, it may be desirable to reduce the thickness of the thermal interface pad. This may be accomplished by vertically compressing the thermal interface pad before the plate assemblies are affixed to each other through the use of one or more threaded rods, or other methods as described above. The first plate 700 is shown including a first opening 706 (in this embodiment, a circular hole), a second opening 708 (in this embodiment, a slot), a ledge 718, prongs 702, and a spring 704. The second plate 710 is shown beneath the first plate 700 including a first opening 714 (in this embodiment, a circular hole), a second opening 716 (in this embodiment, a slot), a ledge 720, prongs, and a spring 712. Note that the springs have been compressed by the ledges of the adjacent thermal interface plates and that the holes and slots have shifted with respect to each other.

Once the thermal interface pad has been created by stacking a plurality of thermal interface plate assemblies the pad may be completed by threading two bolts through the holes and affixing nuts to the bolts. The nuts may be tightened sufficiently to keep the individual thermal interface plate assemblies from shifting, and to increase the thermal conductivity between adjacent plate assemblies. Other embodiments of the present invention may include springs surrounding the bolts under each of the nuts. These springs may supply sufficient pressure to keep the individual plate in contact while allowing the plates to slide past each other while conforming to the structure of the gap that the thermal interface pad is filling.

Figure 8:
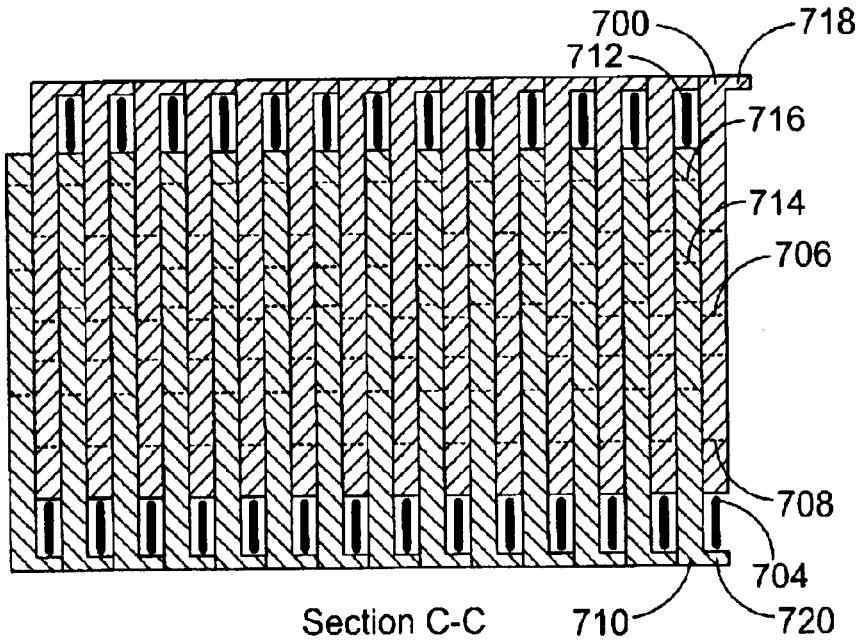
FIG. 8 is a cross-sectional view of the example embodiment of a thermal interface pad according to the present invention from FIG. 7 along section line C—C.

FIG. 8 is a cross-sectional view of the example embodiment of a thermal interface pad according to the present invention from FIG. 7 along section line C—C. Compare FIG. 8 to FIG. 6 to see that the holes and slots of adjacent plates have shifted with respect to each other. Note that other embodiments of the present invention may use any combination of holes and slots as desired for any given use of the invention. For example, when a single thermal interface pad will be required to bridge gaps of varying distance it may be necessary to use two slots instead of a slot and a hole to allow different offsets between the plates at different points within the thermal interface pad.

Figure 9:
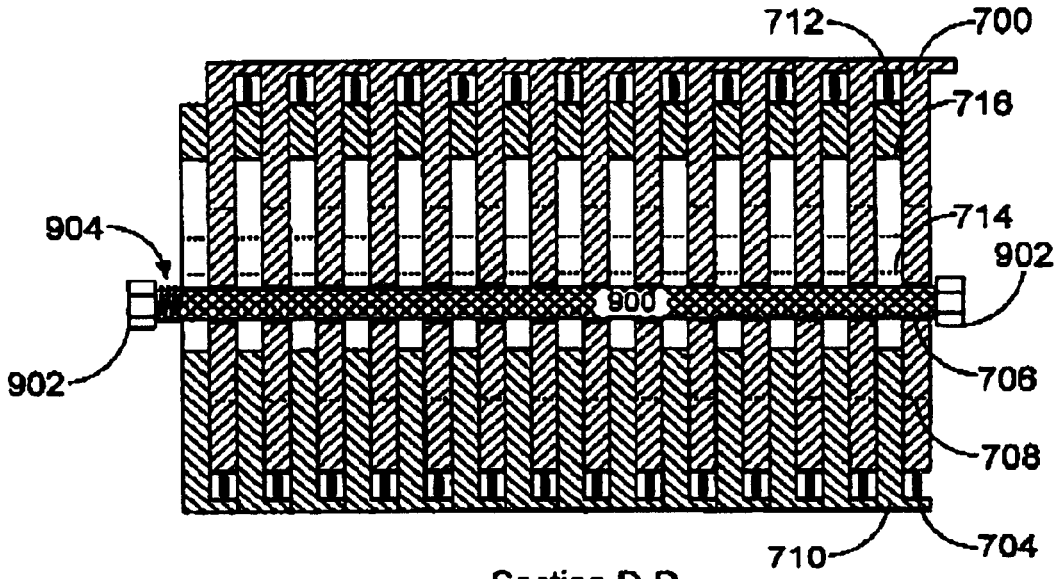
FIG. 9 is a cross-sectional view of an example embodiment of a thermal interface pad according to the present invention from FIG. 7 along section line D—D.

FIG. 9 is a cross-sectional view of in example embodiment of a thermal interface pad according to the present invention from FIG. 7 along section line D—D. To complete assembly of the thermal interface pad a rod 900 is inserted through the left holes and slots of the thermal interface pad. In an example embodiment of the present invention the rod 900 is secured by two nuts 902 and a spring 904.

Figure 10:
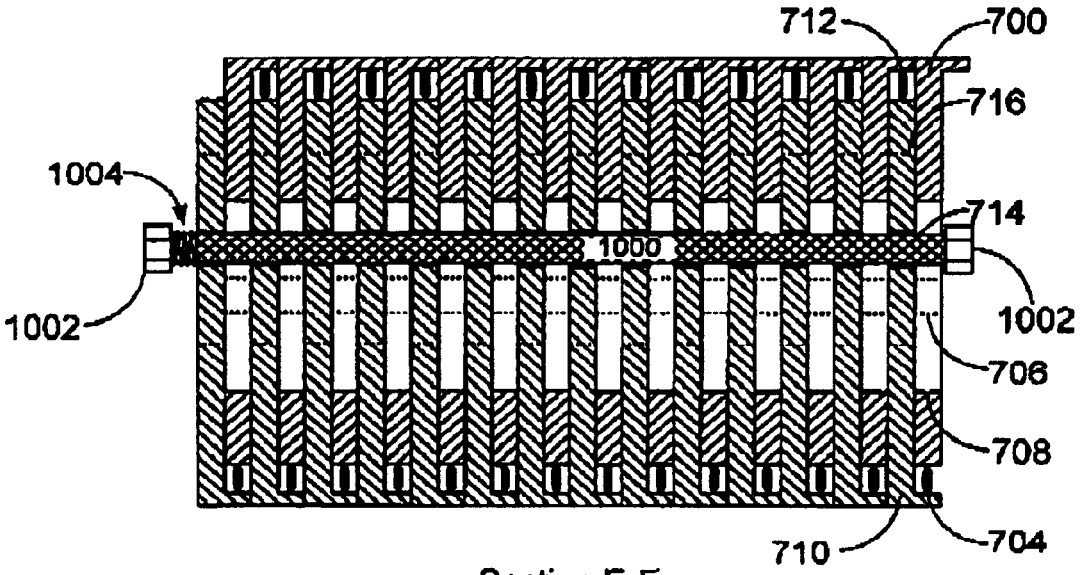
FIG. 10 is a cross-sectional view of an example embodiment of a thermal interface pad according to the present invention from FIG. 7 along section line E—E.

FIG. 10 is a cross-sectional view of an example embodiment of a thermal interface pad according to the present invention from FIG. 7 along section line E—E. To complete assembly of the thermal interface pad a rod 1000 is inserted through the right holes and slots of the thermal interface pad. In an example embodiment of the Present invention the rod 1000 is secured by two nuts 1002 and a spring 1004.

Figure 11A:
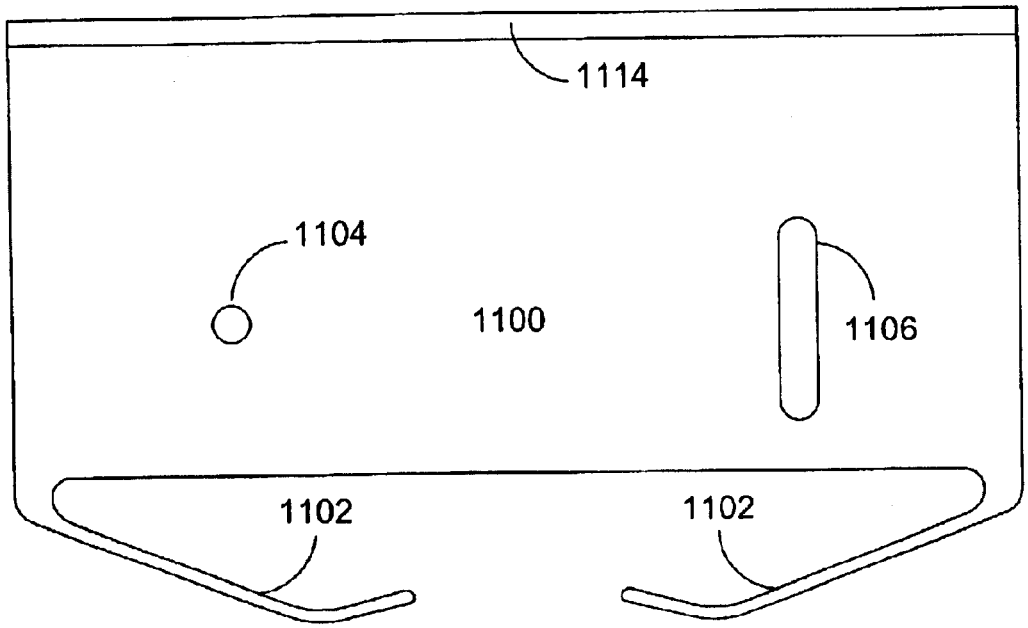
FIG. 11A is a front view of a thermal interface plate assembly according to the present invention.

FIG. 11A is a front view of a thermal interface plate assembly according to the present invention. This example embodiment of the present invention is similar to that shown in FIG. 4A however the thermal interface body is taller than that of FIG. 4A and also includes a ledge 1114 along the top edge. A thermal interface plate 1100 is constructed from any thermally conductive material, such as aluminum or copper, including two spring members 1102, a first opening 1104 (in this embodiment, a circular hole) and a second opening 1106 (in this embodiment, a slot). In some embodiments of the present invention the spring members 1102 may be fabricated separately from the thermal interface plate 1100, and during manufacture mechanically affixed to the thermal interface plate 1100 through a process such as soldering or welding. Note that any number of spring members 1102 may be used within the scope of the present invention. The first opening 1104 may be any shape as desired to receive a rod used to hold a plurality of thermal interface plates 1100 together and apply compression to the plurality of thermal interface plates 1100 as needed by a particular implementation of the present invention. Similar to the embodiment of the present invention shown in FIG. 4A, the first opening 1104 and second opening 1106 are configured to align with a corresponding second opening 1106 and first opening 1104 in an adjacent thermal interface plate 1100 that is rotated about 180 degrees. This allows a thermal interface pad constructed from a plurality of like thermal interface plate assemblies to be adjustable in thickness. In some embodiments of the present invention, adjustable thickness may not be necessary or desirable, in which case the thermal interface plate 1100 may be constructed with one or more holes and no slots, thus eliminating thickness adjustability.

Figure 11B:
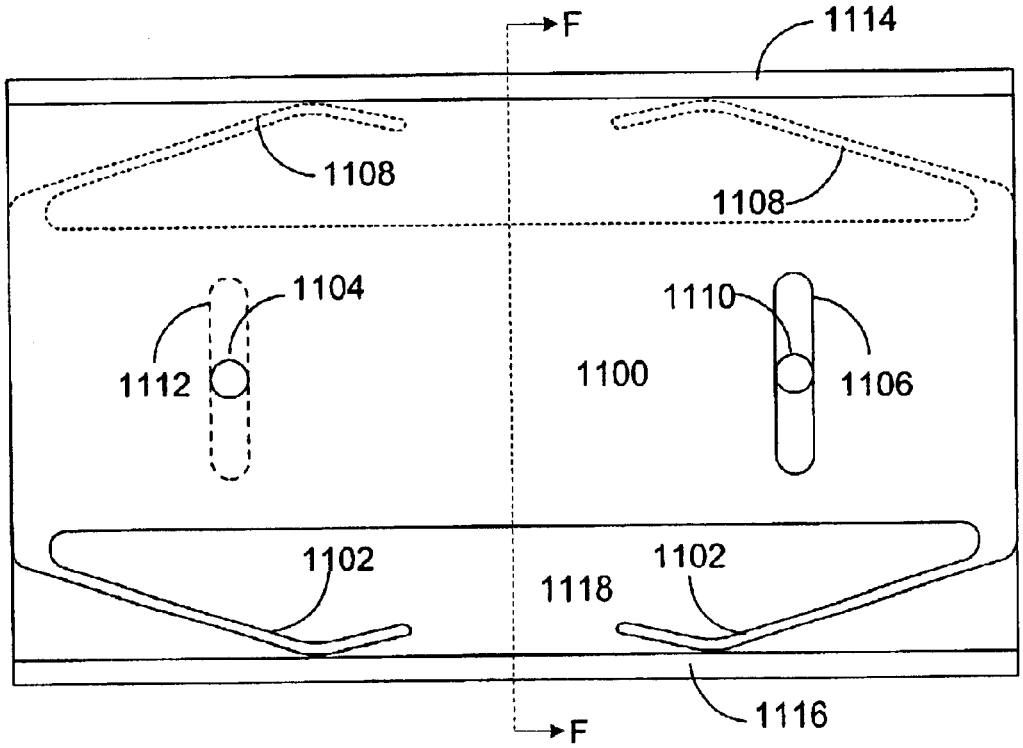
FIG. 11B is a front view of an example embodiment of a thermal interface pad comprising a plurality of thermal interface plate assemblies from FIG. 11A according to the present invention.

FIG. 11B is a front view of an example embodiment of a thermal interface pad comprising a plurality of thermal interface plate assemblies from FIG. 11A according to the present invention. A thermal interface plate assembly from FIG. 11A is shown on top of a plurality of similar thermal interface plate assemblies. Alternate plate assemblies are rotated about 180 degrees from each other within the thermal interface pad. This alternation of plate assemblies results in a pad with a plurality of springs facing opposing surfaces of the final thermal interface pad. In this example embodiment of the present invention, the individual thermal interface plates are configured to overlap the pairs of spring members of adjacent plates. The ledges are used to protect the spring members from any contact with external devices. Each spring member may be enclosed by two adjacent thermal interface plates. A second plate 1118 may be seen directly behind the first plate 1100. The first plate includes a first opening 1104 (in this embodiment, a circular hole), second opening 1106 (in this embodiment, a slot), a ledge 1114, and a pair of spring members 1102. The second plate 1118 includes a first opening 1110 (in this embodiment, a circular hole), a second opening 1112 (in this embodiment, a slot), a ledge 1116, and a pair of spring members 1108 attached to the second plate. Notice that since alternating plates are rotated about 180 degrees from each other, the holes in plates with springs facing up are aligned with the slots from the plates with springs facing down. Likewise, the slots in plates with springs facing up are aligned with the holes from the plates with springs facing down. Rods may then be inserted in both sets of holes such that the two rods may slide vertically within the slots. This allows the thickness of the thermal interface pad to be adjusted within the limits defined by the dimensions of the holes and slots. Threaded rods may be used with nuts to tighten the stack of plate assemblies into a thermal interface pad that is of a set thickness. This clamping of the stack also may apply pressure between adjacent plates greatly improving the thermal conductivity between plates allowing greater dissipation of any hot spots within the pad.

Figure 12A:
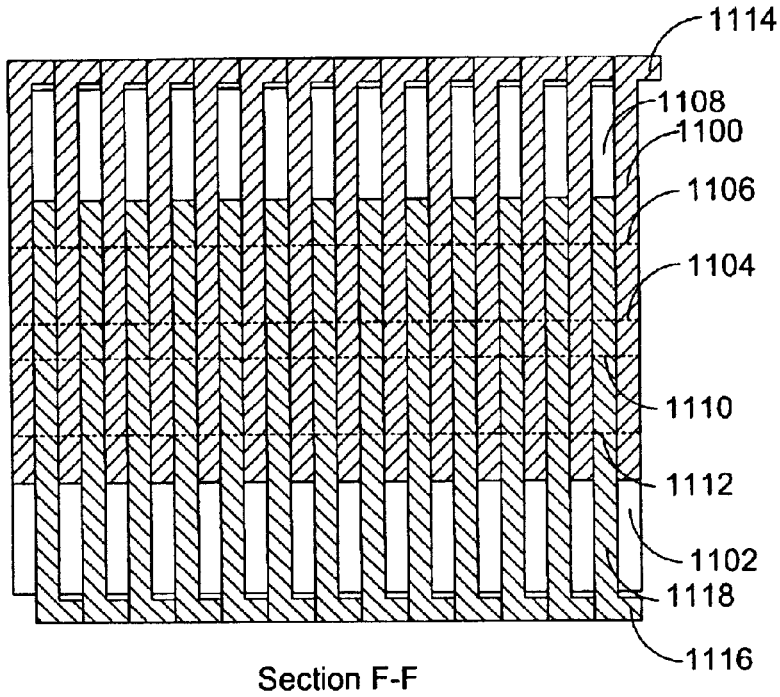
FIG. 12A is a cross-sectional view of the example embodiment of a thermal interface pad according to the present invention from FIG. 11B along section line F—F.

FIG. 12A is a cross-sectional view of the example embodiment of a thermal interface pad according to the present invention from FIG. 11B along section line F—F.

Figure 12B:
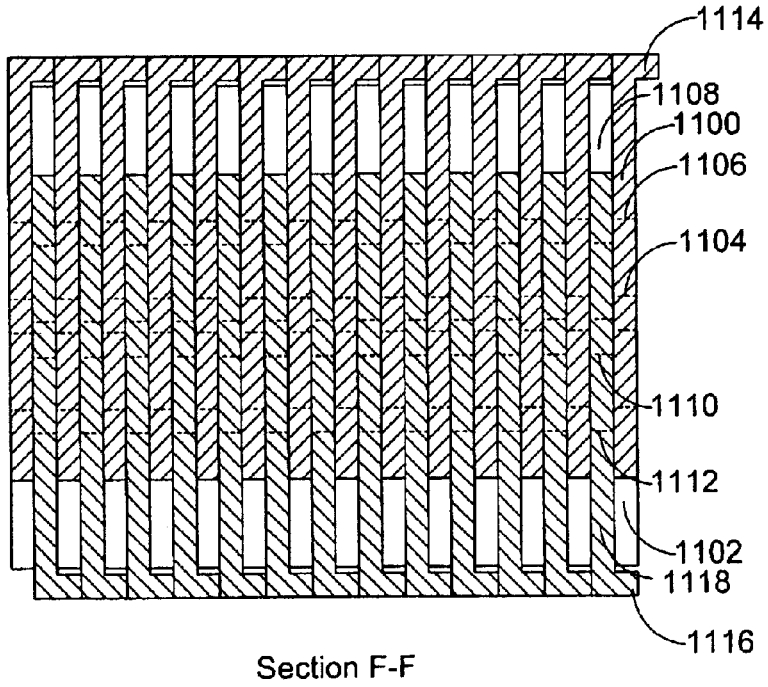
FIG. 12B is a cross-sectional view of the example embodiment of a thermal interface pad according to the present invention from FIG. 11B along section line F—F after compression.

FIG. 12B is a cross-sectional view of the example embodiment of a thermal interface pad according to the present invention from FIG. 11B along section line F—F after compression. Note that in this example embodiment of the present invention the slots and holes of half of the plates have shifted vertically with respect to the slots and holes of the other plates. Bolts may be inserted into each of the sets of holes and nuts may be tightened on the bolts to compress the thermal interface pad preventing movement of the individual plate assemblies and increasing thermal conductivity between individual plate assemblies.

Figure 13:
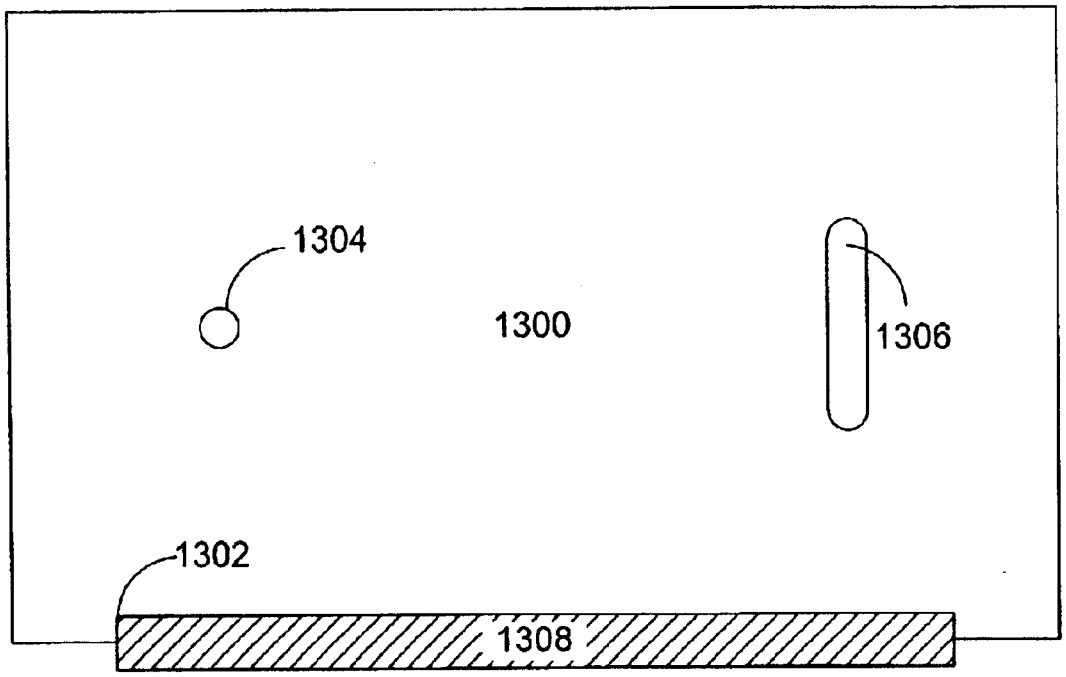
FIG. 13 is a front view of an example embodiment of a thermal interface plate assembly according to the present invention.

FIG. 13 is a front view of an example embodiment of a thermal interface plate assembly according to the present invention. In this example embodiment of the present invention a plate 1300 is constructed including a first opening 1304 (in this example, a circular hole), a second opening 1306 (in this example, a slot), and a notch 1302 along one edge. An elastomeric conductor 1308 is placed within the notch such that a portion of the elastomeric conductor 1308 extends beyond the edge of the plate 1300. When stacked in alternating orientation these plate assemblies are adjustable in thickness as in the preceding embodiments of the present invention and the elastomeric conductor 1308 provides a low thermal resistance contact to the heat generating and sinking devices.

Figure 14:
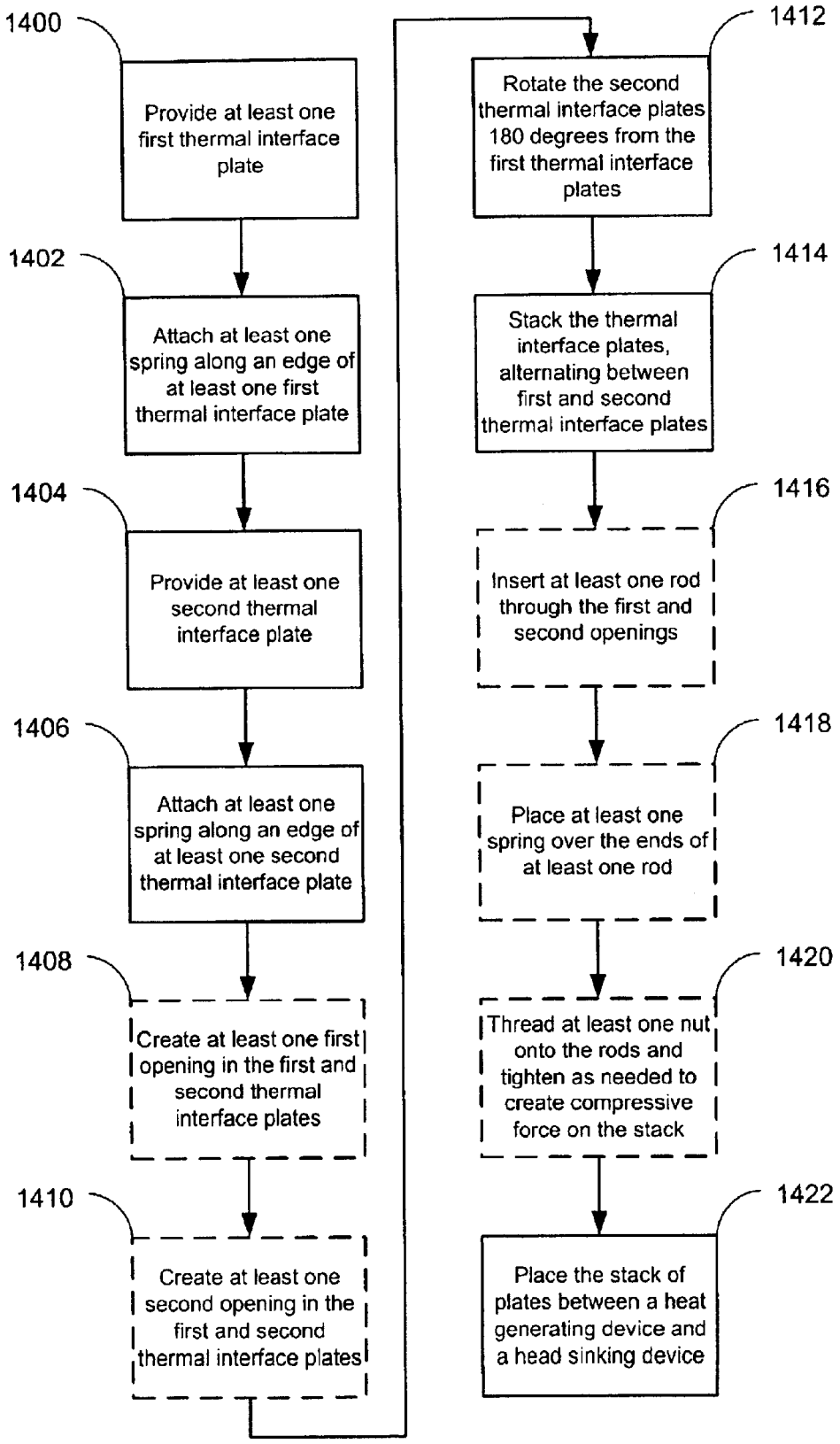
FIG. 14 is a flow chart of an example embodiment of a method for the construction of a thermal interface pad according to the present invention.

FIG. 14 is a flow chart of an example embodiment of a method for the construction of a thermal interface pad similar to that shown in FIGS. 3A and 3B according to the present invention. In a step 1400 at least one first thermal interface plate is provided. In a step 1402 at least one spring is attached along an edge of at least one first thermal interface plate. In a step 1404 at least one second thermal interface plate is provided. In a step 1406 at least one spring is attached along an edge of at least one second thermal interface plate. In an optional step 1408 at least one first opening is created in the first and second thermal interface plates. In an optional step 1410 at least one second opening is created in the first and second thermal interface plates. In a step 1412 the second thermal interface plates are rotated 180 degrees with respect to the first thermal interface plates. In a step 1414 alternating first and second thermal interface plates are stacked. In an optional step 1416 at least one rod is inserted through the first and second openings. In an optional step 1418 at least one spring is placed over the ends of at least one rod. In an optional step 1420 at least one nut is threaded onto at least one rod and tightened as needed to create a compressive force on the stack of plates. In a step 1422 the stack of plates is placed between a heat generating device and a heat sinking device.

Figure 15:
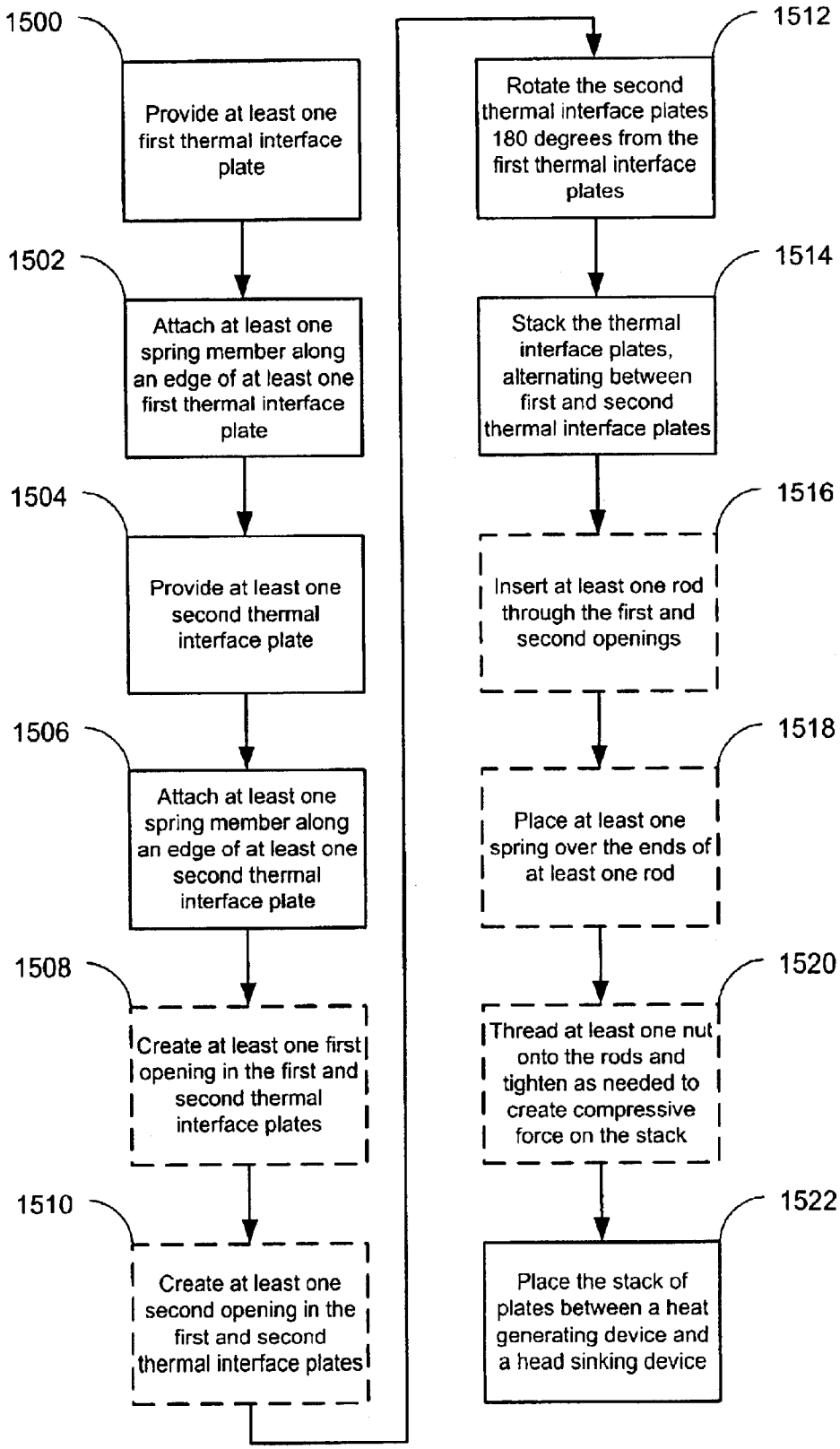
FIG. 15 is a flow chart of an example embodiment of a method for the construction of a thermal interface pad according to the present invention.

FIG. 15 is a flow chart of an example embodiment of a method for the construction of a thermal interface pad similar to that shown in FIGS. 4A and 4B according to the present invention. In a step 1500 at least one first thermal interface plate is provided. In a step 1502 at least one spring member is attached along an edge of at least one first thermal interface plate. In a step 1504 at least one second thermal interface plate is provided. In a step 1506 at least one spring member is attached along an edge of at least one second thermal interface plate. In an optional step 1508 at least one first opening is created in the first and second thermal interface plates. In an optional step 1510 at least one second opening is created in the first and second thermal interface plates. In a step 1512 the second thermal interface plates are rotated 180 degrees with respect to the first thermal interface plates. In a step 1514 alternating first and second thermal interface plates are stacked. In an optional step 1516 at least one rod is inserted through the first and second openings. In an optional step 1518 at least one spring is placed over the ends of at least one rod. In an optional step 1520 at least one nut is threaded onto at least one rod and tightened as needed to create a compressive force on the stack of plates. In a step 1522 the stack of plates is placed between a heat generating device and a heat sinking device.

Figure 16:
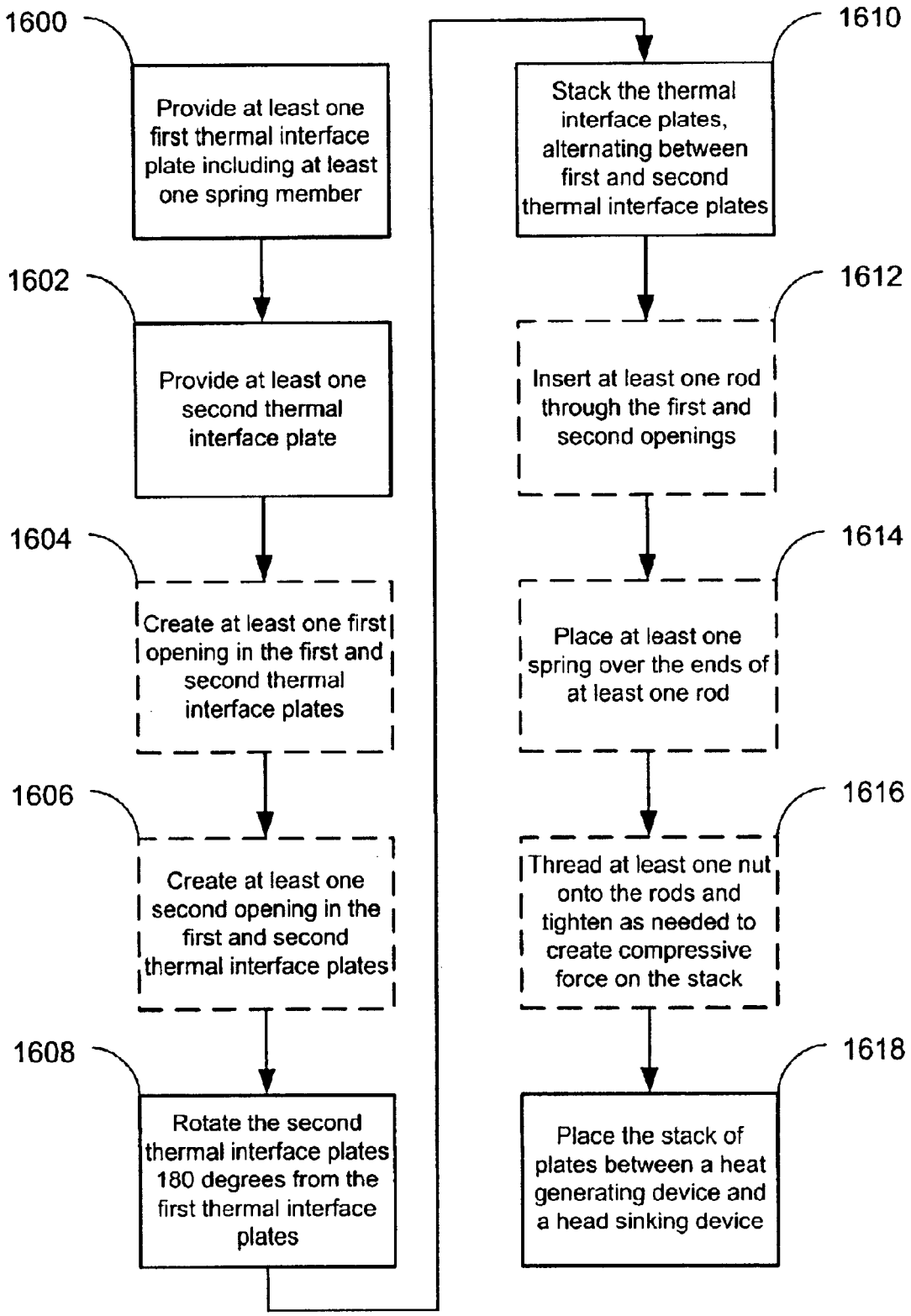
FIG. 16 is a flow chart of an example embodiment of a method for the construction of a thermal interface pad according to the present invention.

FIG. 16 is a flow chart of an example embodiment of a method for the construction of a thermal interface pad similar to that shown in FIGS. 4A and 4B according to the present invention. In a step 1600 at least one first thermal interface plate including at least one spring member is provided. In a step 1602 at least one second thermal interface plate including at least one spring member is provided. In an optional step 1604 at least one first opening is created in the first and second thermal interface plates. In an optional step 1606 at least one second opening is created in the first and second thermal interface plates. In a step 1608 the second thermal interface plates are rotated 180 degrees with respect to the first thermal interface plates. In a step 1610 alternating first and second thermal interface plates are stacked. In an optional step 1612 at least one rod is inserted through the first and second openings. In an optional step 1614 at least one spring is placed over the ends of at least one rod. In an optional step 1616 at least one nut is threaded onto at least one rod and tightened as needed to create a compressive force on the stack of plates. In a step 1618 the stack of plates is placed between a heat generating device and a heat sinking device.

Figure 17:
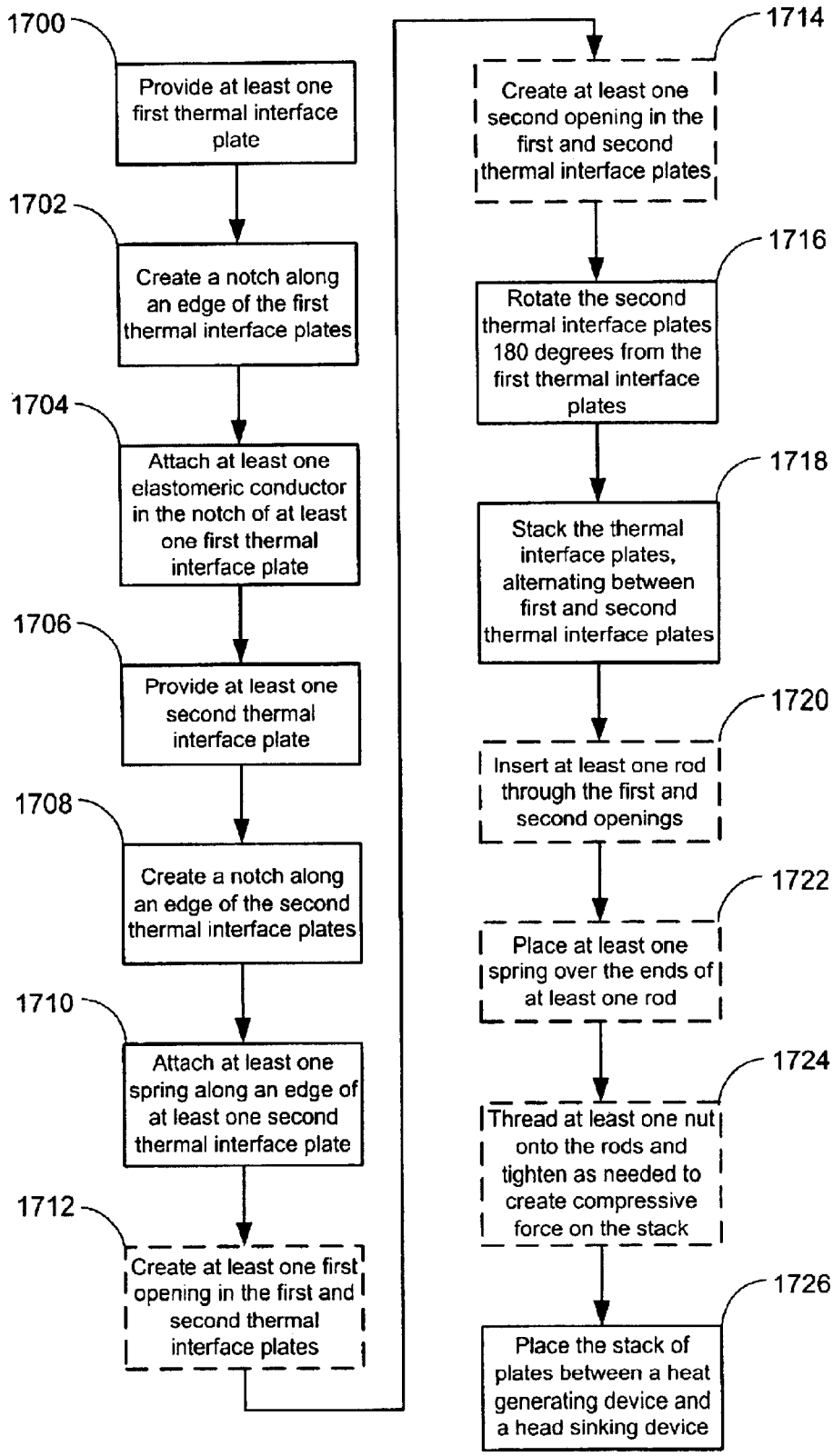
FIG. 17 is a flow chart of an example embodiment of a method for the construction of a thermal interface pad according to the present invention.

FIG. 17 is a flow chart of an example embodiment of a method for the construction of a thermal interface pad similar to that shown in FIG. 13 according to the present invention. In a step 1700 at least one first thermal interface plate is provided. In a step 1702 a notch is created along an edge of at least one of the first thermal interface plates. In a step 1704 at least one elastomeric conductor is attached in the notch of at least one first thermal interface plate. In a step 1706 at least one second thermal interface plate is provided. In a step 1708 a notch is created along an edge of at least one of the second thermal interface plates. In a step 1710 at least one elastomeric conductor is attached in the notch of at least one second thermal interface plate. In an optional step 1712 at least one first opening is created in the first and second thermal interface plates. In an optional step 1714 at least one second opening is created in the first and second thermal interface plates. In a step 1716 the second thermal interface plates are rotated 180 degrees with respect to the first thermal interface plates. In a step 1718 alternating first and second thermal interface plates are stacked. In an optional step 1720 at least one rod is inserted through the first and second openings. In an optional step 1722 at least one spring is placed over the ends of at least one rod. In an optional step 1724 at least one nut is threaded onto at least one rod and tightened as needed to create a compressive force on the stack of plates. In a step 1726 the stack of plates is placed between a heat generating device and a heat sinking device.

Figure 18:
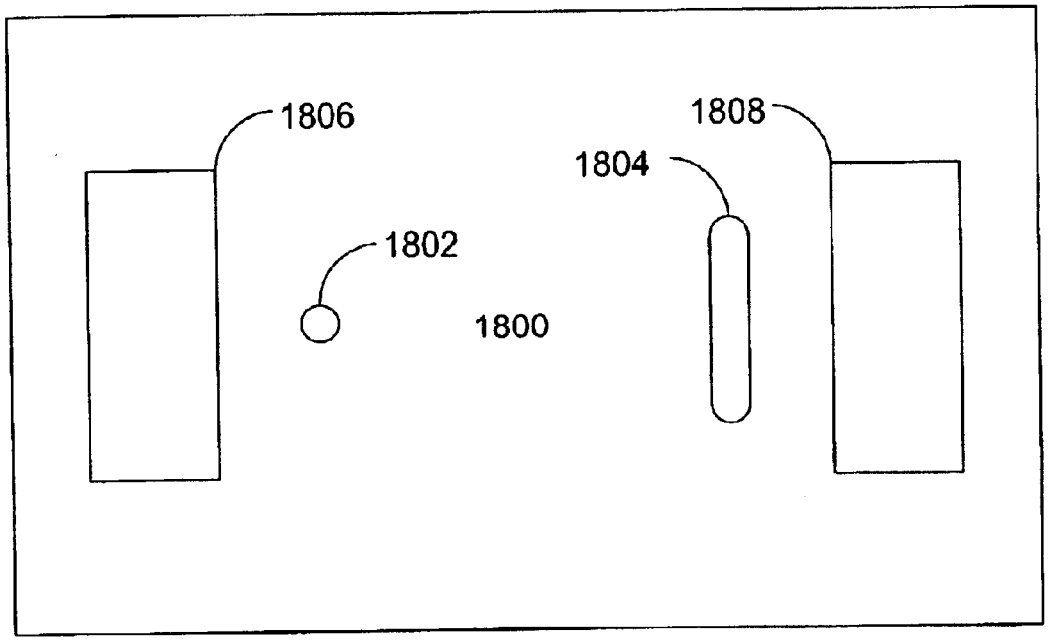
FIG. 18 is a front view of an example embodiment of a thermal interface plate assembly according to the present invention.

FIG. 18 is a front view of an example embodiment of a thermal interface plate assembly according to the present invention. A thermal interface plate 1800 is constructed from any thermally conductive material, such as aluminum or copper, including a first opening 1802 (in this embodiment, a circular hole) and a second opening 1804 (in this embodiment, a slot). The first opening 1802 may be any shape as desired to receive a rod used to hold a plurality of thermal interface plates 1800 together and apply compression to the plurality of thermal interface plates 1800 as needed by a particular implementation of the present invention. The second opening 1804 in an example embodiment of the present invention is configured to allow the rod to move in at least one direction. The thermal interface plate 1800 also includes a first elastomer opening 1806 (in this embodiment, a rectangular opening in the left side of the plate) and a second elastomer opening 1808 (in this embodiment, a rectangular opening in the right side of the plate). The completed plate 1800 including the first opening 1802, second opening 1804, first elastomer opening 1806 and second elastomer opening 1808 is termed a thermal interface plate assembly. Upon assembly into a thermal interface pad a plurality of thermal interface plate assemblies stacked in alternating 180 degree orientations allow elastomers to be placed within the first and second elastomer openings 1806, 1808. Since the elastomers are compressible, the alternating plates may slide with respect to each other, resulting in a thermal interface pad capable of widely varying in thickness. Also, those of skill in the art will realize that a large amount of heat is transferred between the thermal interface plates where they are in contact with adjacent plates. Because of this, the elastomers may be thermally conductive, but need not be conductive for the purposes of an example embodiment of the present invention.

Figure 19:
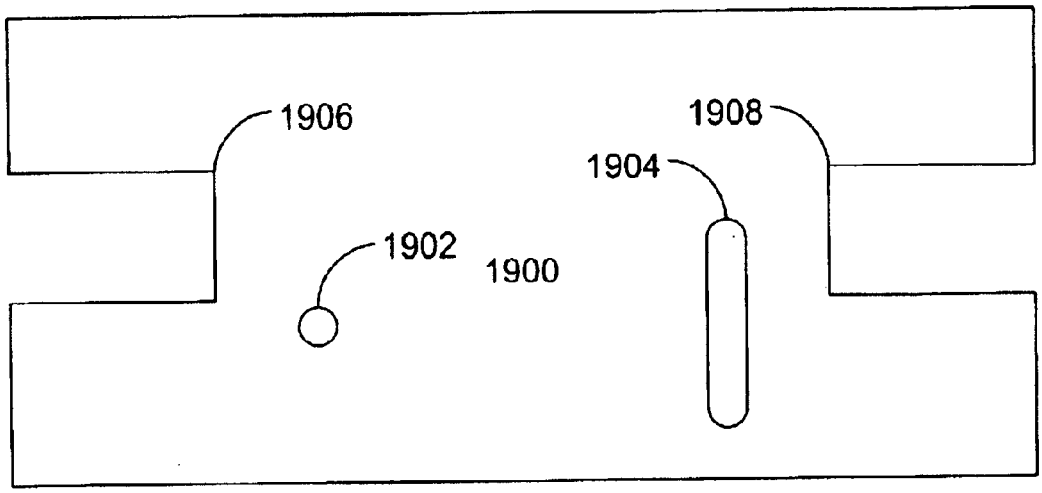
FIG. 19 is a front view of an example embodiment of a thermal interface plate assembly according to the present invention.

FIG. 19 is a front view of an example embodiment of a thermal interface plate assembly according to the present invention. A thermal interface plate 1900 is constructed from any thermally conductive material, such as aluminum or copper, including a first opening 1902 (in this embodiment, a circular hole) and a second opening 1904 (in this embodiment, a slot). The first opening 1902 may be any shape as desired to receive a rod used to hold a plurality of thermal interface plates 1900 together and apply compression to the plurality of thermal interface plates 1900 as needed by a particular implementation of the present invention. The second opening 1904 in an example embodiment of the present invention is configured to allow the rod to move in at least one direction. The thermal interface plate 1900 also includes a first elastomer opening 1906 (in this embodiment, a notch in the left side of the plate) and a second elastomer opening 1908 (in this embodiment, a notch in the right side of the plate). The completed plate 1900 including the first opening 1902, second opening 1904, first elastomer opening 1906 and second elastomer opening 1906 is termed a thermal interface plate assembly. Upon assembly into a thermal interface pad a plurality of thermal interface plate assemblies stacked in alternating 180 degree orientations allow elastomers to be placed within the first and second elastomer openings 1906, 1908. Since the elastomers are compressible, the alternating plates may slide with respect to each other, resulting in a thermal interface pad capable of widely varying in thickness.

Figure 20:
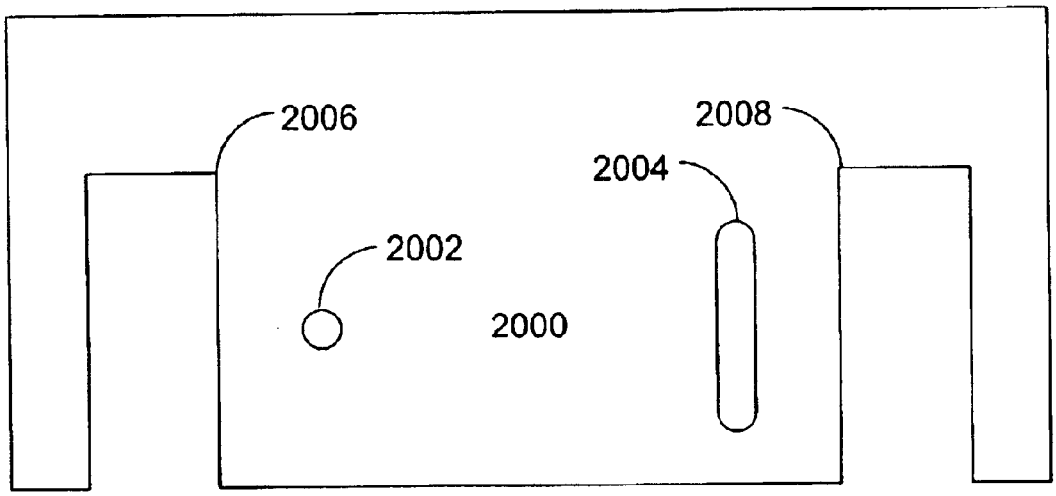
FIG. 20 is a front view of an example embodiment of a thermal interface plate assembly according to the present invention.

FIG. 20 is a front view of an example embodiment of a thermal interface plate assembly according to the present invention. A thermal interface plate 2000 is constructed from any thermally conductive material, such as aluminum or copper, including a first opening 2002 (in this embodiment, a circular hole) and a second opening 2004 (in this embodiment, a slot). The first opening 2002 may be any shape as desired to receive a rod used to hold a plurality of thermal interface plates 2000 together and apply compression to the plurality of thermal interface plates 2000 as needed by a particular implementation of the present invention. The second opening 2004 in an example embodiment of the present invention is configured to allow the rod to move in at least one direction. The thermal interface plate 2000 also includes a first elastomer opening 2006 (in this embodiment, a notch in the bottom left area of the plate) and a second elastomer opening 2008 (in this embodiment, a notch in the bottom right area of the plate). The completed plate 2000 including the first opening 2002, second opening 2004, first elastomer opening 2006 and second elastomer opening 2008 is termed a thermal interface plate assembly. Upon assembly into a thermal interface pad a plurality of thermal interface plate assemblies stacked in alternating 180 degree orientations allow elastomers to be placed within the first and second elastomer openings 2006, 2008. Since the elastomers are compressible, the alternating plates may slide with respect to each other, resulting in a thermal interface pad capable of widely varying in thickness.

Figure 21:
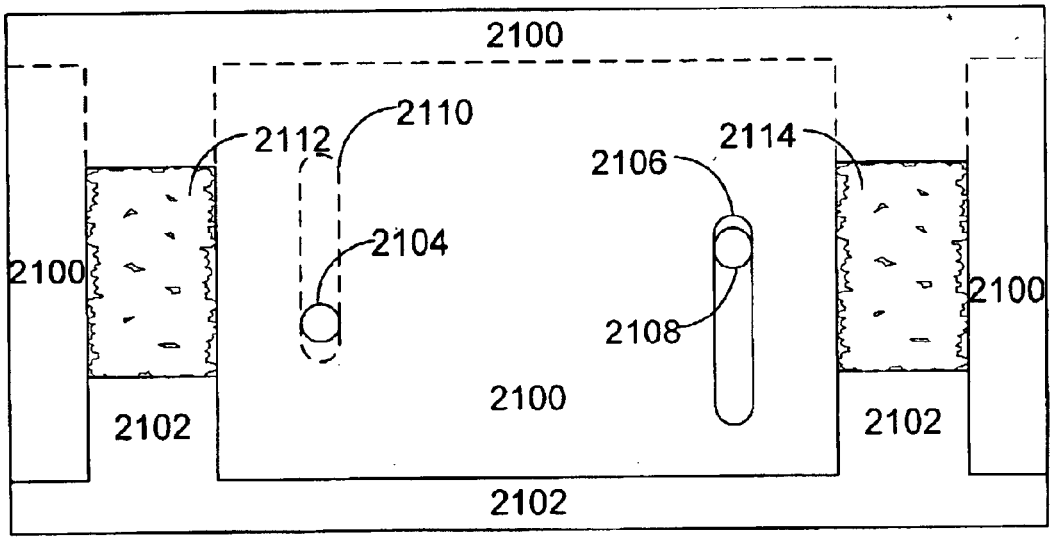
FIG. 21 is a front view of an example embodiment of a thermal interface pad comprising a plurality of thermal interface plate assemblies from FIG. 20 according to the present invention.

FIG. 21 is a front view of an example embodiment of a thermal interface pad comprising a plurality of thermal interface plate assemblies from FIG. 20 according to the present invention. A first thermal interface plate assembly 2100 identical to that from FIG. 20 is shown stacked on top of a second thermal interface plate assembly 2102 rotated 180 degrees from the first assembly 2100. Within the space remaining in the first and second elastomer openings, a first elastomer 2112 and a second elastomer 2114 are placed. Notice that like previous example embodiments of the present invention, the first opening 2104 from the first thermal interface plate assembly 2100 aligns with the second opening 2110 from the second thermal interface plate assembly 2102. Likewise, the second opening 2106 from the first thermal interface plate assembly 2100 aligns with the first opening 2108 from the second thermal interface plate assembly 2102.

Figure 22A:
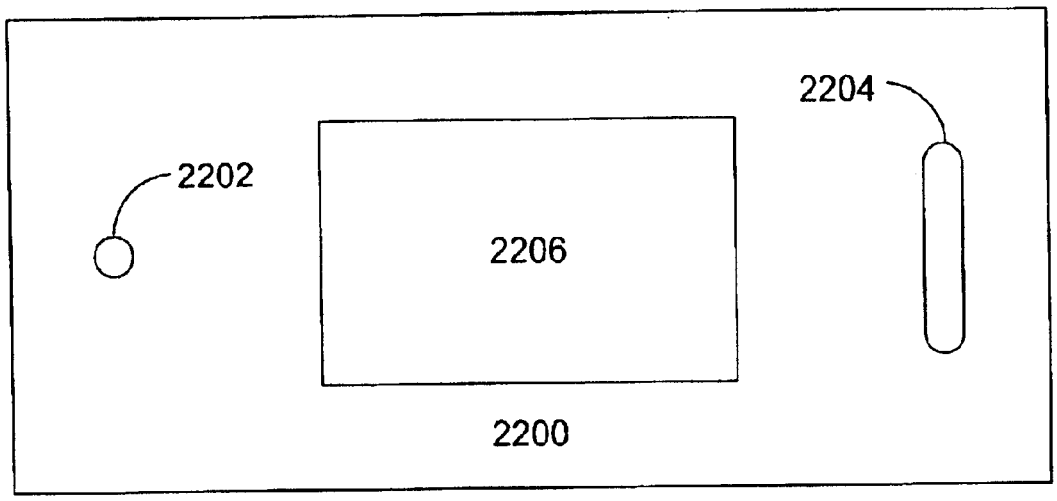
FIG. 22A is a front view of an example embodiment of a thermal interface plate assembly according to the present invention.

FIG. 22A is a front view of an example embodiment of a thermal interface plate assembly according to the present invention. The example embodiment of the present invention shown in FIG. 22A is similar to that of FIG. 18 with a single elastomer opening instead of a pair of elastomer openings. Those of skill in the art will recognize that any number of elastomer openings may be used within the scope of the present invention. A thermal interface plate 2200 is constructed from any thermally conductive material, such as aluminum or copper, including a first opening 2202 (in this embodiment, a circular hole) and a second opening 2204 (in this embodiment, a slot). The first opening 2202 may be any shape as desired to receive a rod used to hold a plurality of thermal interface plates 2200 together and apply compression to the plurality of thermal interface plates 2200 as needed by a particular implementation of the present invention. The second opening 2204 in an example embodiment of the present invention is configured to allow the rod to move in at least one direction. The thermal interface plate 2200 also includes a single elastomer opening 2206 (in this embodiment, a rectangular opening in the center area of the plate). The completed plate 2200 including the first opening 2202, second opening 2204, and elastomer opening 2206 is termed a thermal interface plate assembly. Upon assembly into a thermal interface pad a plurality of thermal interface plate assemblies stacked in alternating 180 degree orientations allow an elastomer to be placed within the elastomer opening 2206. Since the elastomer is compressible, the alternating plates may slide with respect to each other, resulting in a thermal interface pad capable of widely varying in thickness.

Figure 22B:
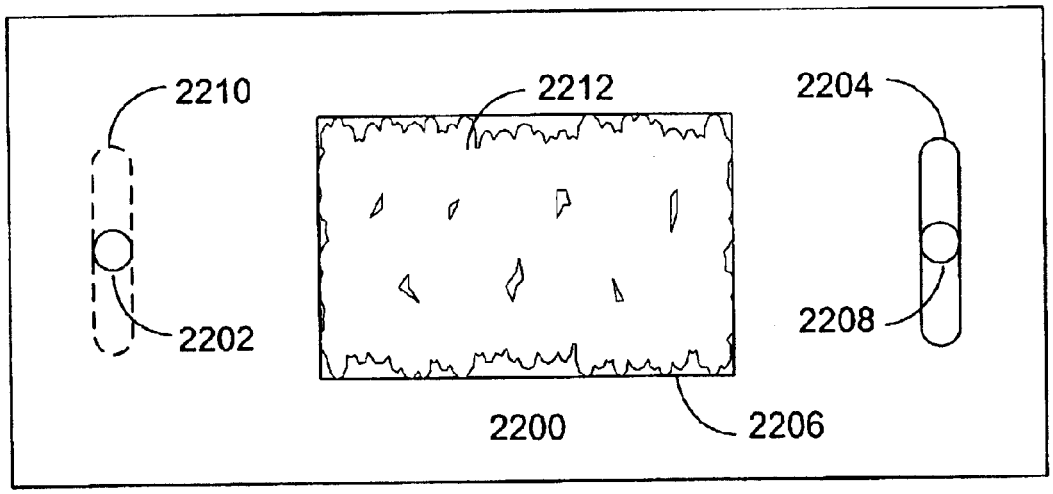
FIG. 22B is a front view of an example embodiment of a thermal interface pad comprising a plurality of thermal interface plate assemblies from FIG. 22A according to the present invention.

FIG. 22B is a front view of an example embodiment of a thermal interface pad comprising a plurality of thermal interface plate assemblies from FIG. 22A according to the present invention. A first thermal interface plate assembly 2200 identical to that from FIG. 22A is shown stacked on top of a second thermal interface plate assembly rotated 180 degrees from the first assembly 2200. Within the space remaining in the elastomer openings 2206, an elastomer 2212 is placed. Notice that like previous example embodiments of the present invention, the first opening 2202 from the first thermal interface plate assembly 2200 aligns with the second opening 2210 from the second thermal interface plate assembly. Likewise, the second opening 2204 from the first thermal interface plate assembly 2200 aligns with the first opening 2208 from the second thermal interface plate assembly.

Figure 23:
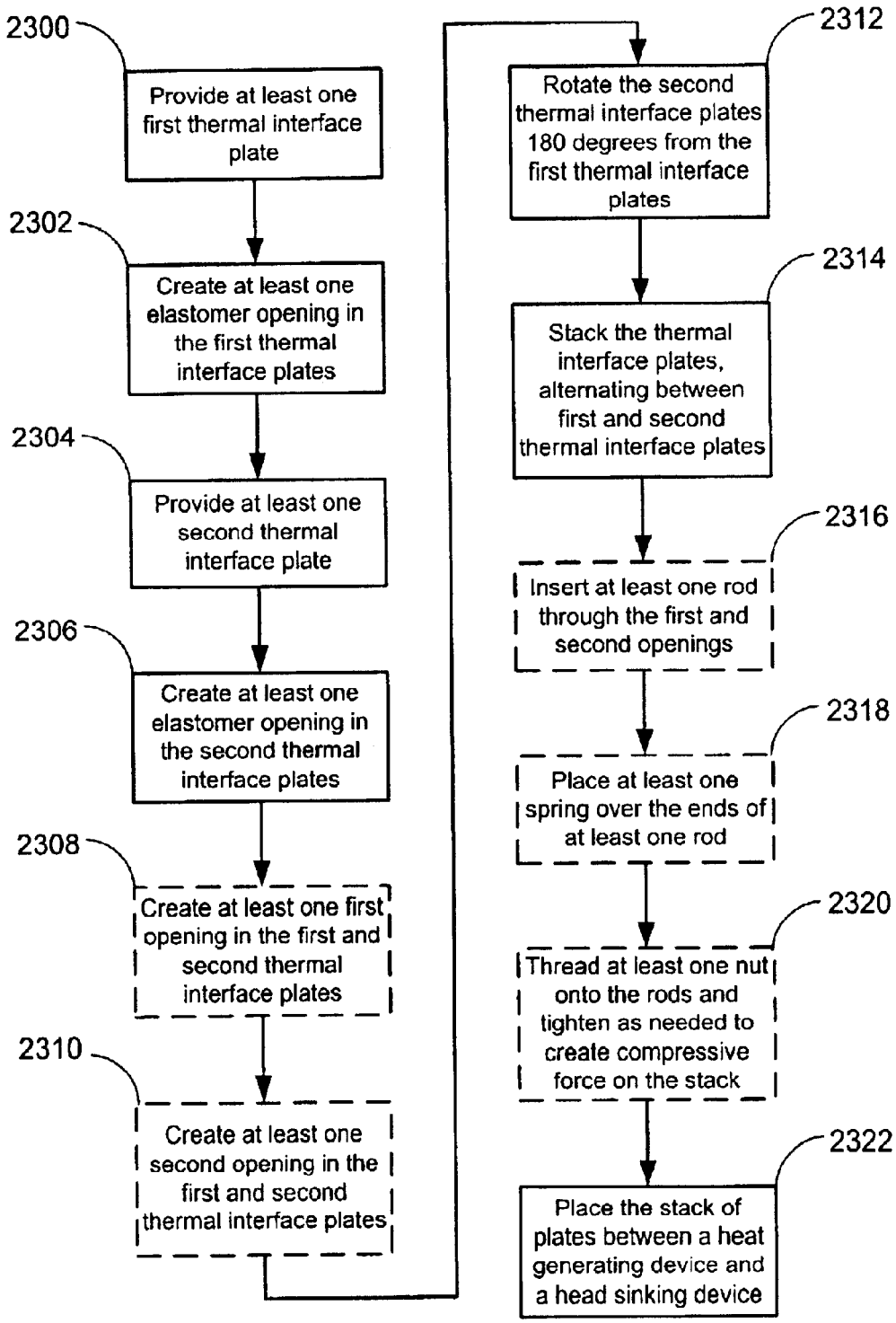
FIG. 23 is a flow chart of an example embodiment of a method for the construction of a thermal interface pad according to the present invention.

FIG. 23 is a flow chart of an example embodiment of a method for the construction of a thermal interface pad according to the present invention. In a step 2300 at least one first thermal interface plate is provided. In a step 2302 at least one elastomer opening is created in at least one of the first thermal interface plates. In a step 2304 at least one second thermal interface plate is provided. In a step 2306 at least one elastomer opening is created in at least one of the second thermal interface plates. In an optional step 2308 at least one first opening is created in the first and second thermal interface plates. In an optional step 2310 at least one second opening is created in the first and second thermal interface plates. In a step 2312 the second thermal interface plates are rotated 180 degrees with respect to the first thermal interface plates. In a step 2314 alternating first and second thermal interface plates are stacked. In an optional step 2316 at least one rod is inserted through the first and second openings. In an optional step 2318 at least one spring is placed over the ends of at least one rod. In an optional step 2320 at least one nut is threaded onto at least one rod and tightened as needed to create a compressive force on the stack of plates. In a step 2322 the stack of plates is placed between a heat generating device and a heat sinking device.

The foregoing description of the present invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A thermal interface pad comprising:

at least one first thermal interface plate assembly;

at least one second thermal interface plate assembly;

wherein said second thermal interface plate assemblies are stacked alternating between said first thermal plate assemblies;

wherein said second thermal interface plate assemblies are rotated within the plane of said second thermal interface plate assemblies about 180 degrees with respect to said first thermal interface plate assemblies; and wherein each of said thermal interface plate assemblies include:

a thermal interface plate, configured to accept attachment of a spring along an edge; and a spring attached to an edge of said thermal interface plate configured to apply a force to an external object, wherein said force is substantially in the plane of said thermal interface plate.

2. A thermal interface pod as recited in claim 1, wherein each of said thermal interface plates further includes at least one opening; and wherein said thermal interface pad further comprises:

at least one red inserted in said openings configured to apply compressive pressure to said thermal interface pad.

3. A thermal interface pad as recited in claim 1, a wherein each of said thermal interface plates further includes:

at least one first opening;

at least one second opening; and wherein said thermal interface pad further comprises:

at least one rod inserted in said first and second openings configured to apply compressive pressure to said thermal interface pad.

4. A thermal interface pad as recited in claim 3, wherein said at least one rod is pressure fit into said first and second openings.

5. A thermal interface pad as recited in claim 3, wherein said at least one rod is a threaded rod.

6. A thermal interface pad as recited in claim 5, farther comprising:

at least one nut threaded onto said at least one rod.

7. A thermal interface pad as recited in claim 6, further comprising:

at least one spring placed around said at least one rod, between said at least one nut and said first and second thermal interface assemblies.

8. A thermal interface pad as recited in claim 3, wherein said at least one second opening is configured to align with said at least one first opening when said thermal interface plate is rotated 180 degrees.

9. A thermal interface pad as recited in claim 8, wherein said at least one first opening is a circular bole.

10. A thermal interface pad as recited in claim 8, wherein said at least one second opening is a slot.

11. A thermal interface pad comprising:

at least one first thermal interface plate assembly;

at least one second thermal interface plate assembly;

wherein said second thermal interface plate assemblies are stacked alternating between said first thermal plate assemblies;

wherein said second thermal interface plate assemblies are rotated within the plane of said second thermal interlace plate assemblies about 180 degrees with respect to said first thermal interface plate assemblies; and wherein each of said thermal interface plate assemblies include:

a thermal interface plate, configured to accept attachment of at least one spring mechanism along an edge; and at least one spring mechanism attached to an edge of said thermal interface plate configured to apply a force to an external object, wherein said force is substantially in the plane of said thermal interface plate.

12. A thermal interface pad as recited an claim 11, wherein each of said thermal interface plates further includes at least one opening; and wherein said thermal interface pad further comprises:

at least one rod inserted in said openings configured to apply compressive pressure to said thermal interface pad.

13. A thermal interface pad as recited in claim 11, wherein each of said thermal interface plates further includes:

at least one first opening;

at least one second opening; and wherein said thermal interface pad further comprises:

at least one rod inserted in said first and second openings configured to apply compressive pressure to said thermal interface pad.

14. A thermal interface pad as recited in claim 13, wherein said at least one rod is pressure fit into said first and second openings.

15. A thermal interface pad as recited in claim 13, wherein said at least one rod is a threaded rod.

16. A thermal interface pad as recited in claim 15, further comprising:

at least one nut threaded onto said at least one rod.

17. A thermal interface pad as recited in claim 16, further comprising:

at least one spring placed around said at least one rod, between said at least one nut and said first and second thermal interface assemblies.

18. A thermal interface pad as recited in claim 13, wherein said at least one second opening is configured to align with said at least one first opening when said thermal interface plate is rotated 180 degrees.

19. A thermal interface pad as recited in claim 18, wherein said at least one first opening is a circular hole.

20. A thermal interface pad as recited in claim 18, wherein said at least one second opening is a slot.

21. A method for the construction of a thermal interface pad, comprising steps of:

a) providing at least one first thermal interface plate;

b) attaching at least one spring to at least one of the first thermal interface plates;

c) providing at least one second thermal interface plate;

d) attaching at least one spring to at least one of the second thermal interface plates;

e) rotating the second thermal interface plates within the plane of said second thermal interface plate assemblies about 180 degrees with respect to said first thermal interface plate assemblies;

f) stacking the first and second thermal interface plates, alternating between said first and second thermal interface plates;

g) placing the stack of thermal interface plates between a heat generating device and a heat sinking device.

22. A method for the construction of a thermal interface pad as recited in claim 21, further comprising the step of:

h) creating at least one opening in each of the first and second thermal interface plates.

23. A method for the construction of a thermal interface pad as recited in claim 21, further comprising the steps of:

h) creating at least one first opening in each of the first and second thermal interface plates; and i) creating at least one second opening in each of the first and second thermal interface plates.

24. A method for the construction of a thermal interface pad as recited in claim 23, further comprising the step of:

j) friction fitting at least one rod through the first and second openings.

25. A method for the construction of a thermal interface pad as recited in claim 23, further comprising the step of:

j) inserting at least one threaded rod through the first and second openings.

26. A method for the construction of a thermal interface pad as recited in claim 25, further comprising the step of:

k) threading at least one nut on the threaded rod in such a configuration as to apply a compressive force on the stack of thermal interface plates.

27. A method for the construction of a thermal interface pad as recited in claim 26, further comprising the step of:

l) placing at least one spring on the threaded rod between the nut and the stack of thermal interface plates in such a configuration as to apply a compressive force on the stack of thermal interface plates.

* * * * *

UNITED STATES PATENT AND TRADEMARK OFFICE

CERTIFICATE OF CORRECTION

PATENT NO. : 6,910,271 B2
APPLICATION NO. : 10/283907
DATED : June 28, 2005
INVENTOR(S) : Eric C. Peterson et al.

It is certified that error appears in the above-identified patent and that said Letters Patent is hereby corrected as shown below:

In column 15, line 43, in Claim 2, delete “pod” and insert -- pad --, therefor.

In column 15, line 47, in Claim 2, delete “red” and insert -- rod --, therefor.

In column 15, line 52, in Claim 3, delete “a” before “wherein”.

In column 15, line 65, in Claim 6, delete “farther” and insert -- further --, therefor, In column 16, line 12, in Claim 9, delete “bole.” and insert -- hole. --, therefor.

In column 16, line 24, in Claim 11, delete “interlace” and insert -- interface --, therefor.

In column 16, line 38, in Claim 12, delete “an” and insert -- in --, therefor.

Signed and Sealed this

Fourth Day of August, 2009

JOHN DOLL
*Acting Director of the United States Patent and Trademark Office*